US011347156B2

(12) United States Patent
Kurachi et al.

(10) Patent No.: US 11,347,156 B2
(45) Date of Patent: May 31, 2022

(54) ELECTRO-CONDUCTIVE MEMBER FOR ELECTROPHOTOGRAPHY, PROCESS CARTRIDGE FOR ELECTROPHOTOGRAPHY, AND ELECTROPHOTOGRAPHIC IMAGE FORMING APPARATUS

(71) Applicant: CANON KABUSHIKI KAISHA, Tokyo (JP)

(72) Inventors: Masahiro Kurachi, Susono (JP); Kazuhiro Yamauchi, Suntou-gun (JP); Satoru Nishioka, Suntou-gun (JP); Kenji Takashima, Yokohama (JP); Yuichi Kikuchi, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/825,611

(22) Filed: Mar. 20, 2020

(65) Prior Publication Data

US 2020/0310264 A1 Oct. 1, 2020

(30) Foreign Application Priority Data

Mar. 29, 2019 (JP) ..... JP2019-069098

(51) Int. Cl.
*G03G 5/10* (2006.01)
*G03G 21/18* (2006.01)
*G03G 15/00* (2006.01)

(52) U.S. Cl.
CPC ..... *G03G 5/105* (2013.01); *G03G 15/75* (2013.01); *G03G 21/1814* (2013.01)

(58) Field of Classification Search
CPC ..... G03G 5/105; G03G 15/75; G03G 15/751; G03G 15/752; G03G 15/754; G03G 15/755; G03G 21/1814
See application file for complete search history.

(56) References Cited

U.S. PATENT DOCUMENTS 6,697,587 B2 2/2004 Harada
7,799,398 B2 9/2010 Nakamura et al.
(Continued)

FOREIGN PATENT DOCUMENTS

JP H05-72889 3/1993
JP 2000-336212 12/2000
(Continued)

OTHER PUBLICATIONS

U.S. Appl. No. 16/828,572, Satoru Nishioka, filed Mar. 24, 2020.
U.S. Appl. No. 16/829,309, Yuichi Kikuchi, filed Mar. 25, 2020.

*Primary Examiner* — Maria V Ewald
*Assistant Examiner* — Ethan Weydemeyer
(74) *Attorney, Agent, or Firm* — Venable LLP

(57) ABSTRACT

The electro-conductive member has an electro-conductive support, and an electro-conductive layer in this order, the electro-conductive layer including a matrix and domains, the matrix constituted by a first rubber composition containing a cross-linked product of a first rubber, the domains having electro-conductivity, and dispersed in the matrix, each of the domains constituted by a second rubber composition containing a cross-linked product of a second rubber and an electro-conductive particle, the first rubber and the second rubber being diene-based rubbers, the first rubber having at least one monomer unit, the second rubber having at least one monomer unit different from the monomer unit which the first rubber has; a difference of absolute values of SP values between the first rubber and the second rubber is 0.2 $(J/cm^3)^{0.5}$ to 4.0 $(J/cm^3)^{0.5}$; and a tan δ1/tan δ2 is 0.45 to 2.00.

11 Claims, 9 Drawing Sheets

(56) References Cited

U.S. PATENT DOCUMENTS

| | | | |
|---|---|---|---|
| 8,298,670 | B2 | 10/2012 | Muranaka et al. |
| 8,449,975 | B2 | 5/2013 | Hirakoso et al. |
| 8,491,994 | B2 | 7/2013 | Harada et al. |
| 8,503,916 | B2 | 8/2013 | Anan et al. |
| 8,628,854 | B2 | 1/2014 | Yamauchi et al. |
| 8,660,472 | B2 | 2/2014 | Kurachi et al. |
| 8,668,987 | B2 | 3/2014 | Yamauchi et al. |
| 8,715,830 | B2 | 5/2014 | Yamada et al. |
| 8,771,818 | B2 | 7/2014 | Nishioka et al. |
| 8,852,743 | B2 | 10/2014 | Kikuchi et al. |
| 9,023,465 | B2 | 5/2015 | Yamada et al. |
| 9,086,643 | B2 | 7/2015 | Kikuchi et al. |
| 9,128,403 | B2 | 9/2015 | Yamauchi et al. |
| 9,146,482 | B2 | 9/2015 | Watanabe et al. |
| 9,360,789 | B1 | 7/2016 | Masu et al. |
| 9,442,408 | B2 | 9/2016 | Yamauchi et al. |
| 9,442,451 | B2 | 9/2016 | Yamauchi et al. |
| 9,541,854 | B2 | 1/2017 | Kikuchi et al. |
| 9,547,250 | B2 | 1/2017 | Kikuchi et al. |
| 9,551,949 | B2 | 1/2017 | Yamauchi et al. |
| 9,556,359 | B2 | 1/2017 | Suzumura et al. |
| 9,581,931 | B2 | 2/2017 | Yamada et al. |
| 9,599,913 | B2 | 3/2017 | Nishioka et al. |
| 9,639,009 | B2 | 5/2017 | Yamaguchi et al. |
| 9,651,888 | B2 | 5/2017 | Muranaka et al. |
| 9,665,028 | B2 | 5/2017 | Arimura et al. |
| 9,665,029 | B2 | 5/2017 | Hino et al. |
| 9,740,133 | B2 | 8/2017 | Yamauchi et al. |
| 9,811,009 | B2 | 11/2017 | Yamada et al. |
| 9,811,021 | B2 | 11/2017 | Muranaka et al. |
| 9,897,931 | B2 | 2/2018 | Nishioka et al. |
| 9,958,802 | B2 | 5/2018 | Kikuchi et al. |
| 9,964,914 | B2 | 5/2018 | Arimura et al. |
| 9,977,353 | B2 | 5/2018 | Nishioka et al. |
| 10,018,927 | B2 | 7/2018 | Yamada et al. |
| 10,018,934 | B2 | 7/2018 | Yamada et al. |
| 10,108,129 | B2 | 10/2018 | Yamaguchi et al. |
| 10,280,148 | B2 | 5/2019 | Nishioka et al. |
| 10,416,588 | B2 | 9/2019 | Masu et al. |
| 2011/0176833 | A1* | 7/2011 | Harada ..... C08L 15/00 399/176 |
| 2012/0308261 | A1 | 12/2012 | Tsuru et al. |
| 2013/0281276 | A1 | 10/2013 | Watanabe et al. |
| 2013/0310239 | A1* | 11/2013 | Terada ..... G03G 15/02 492/18 |
| 2014/0072343 | A1 | 3/2014 | Masu et al. |
| 2014/0080691 | A1 | 3/2014 | Kurachi et al. |
| 2015/0331342 | A1 | 11/2015 | Yamaguchi et al. |
| 2015/0331346 | A1 | 11/2015 | Yamaguchi et al. |
| 2018/0088476 | A1 | 3/2018 | Takashima et al. |
| 2018/0088483 | A1 | 3/2018 | Kikuchi et al. |

FOREIGN PATENT DOCUMENTS

| | | |
|---|---|---|
| JP | 2002-003651 | 1/2002 |
| JP | 2012-163954 | 8/2012 |

* cited by examiner

ELECTRO-CONDUCTIVE MEMBER FOR ELECTROPHOTOGRAPHY, PROCESS CARTRIDGE FOR ELECTROPHOTOGRAPHY, AND ELECTROPHOTOGRAPHIC IMAGE FORMING APPARATUS

BACKGROUND OF THE INVENTION

Field of the Invention

The present disclosure relates to an electro-conductive member which is used in forming an electrophotographic image. The present disclosure also relates to a process cartridge for electrophotography, which uses the electro-conductive member, and an electrophotographic image forming apparatus.

Description of the Related Art

In an electrophotographic image forming apparatus, an electro-conductive member is used as a charging member, a transfer member and a developing member. Each of the charging member and the transfer member has a function of charging a member to be charged, by discharging electricity to the member to be charged such as an electrophotographic photosensitive member or paper, which is arranged so as to face the member.

Japanese Patent Application Laid-Open No. 2002-3651 discloses: a rubber composition having a matrix-domain structure that includes a continuous phase of a polymer which is formed from an ion-conductive rubber material mainly formed from a raw rubber A having a volume specific resistivity of $1\times10^{12}$ Ω·cm or smaller, and a particle phase of a polymer which is formed from an electron conductive rubber material that has been made electro-conductive by an electro-conductive particle blended in a raw rubber B; and a charging member having an elastic layer that is formed from the rubber composition.

SUMMARY OF THE INVENTION

One aspect of the present disclosure is directed to providing an electro-conductive member for electrophotography, which can uniformly charge a member to be charged, even if compression set has occurred therein. In addition, another aspect of the present disclosure is directed to providing a process cartridge for electrophotography, which contributes to stable formation of a high-quality electrophotographic image. Further, another aspect of the present disclosure is directed to providing an electrophotographic image forming apparatus that can stably form the high-quality electrophotographic image.

According to one aspect of the present disclosure, there is provided an electro-conductive member for electrophotography having an electro-conductive support and an electro-conductive layer in this order, the electro-conductive layer including a matrix and domains, the matrix being constituted by a first rubber composition that contains a cross-linked product of a first rubber, the domains having electro-conductivity, and being dispersed in the matrix, each of the domains being constituted by a second rubber composition that contains a cross-linked product of a second rubber and an electro-conductive particle, the first rubber and the second rubber being diene-based rubbers, the first rubber having at least one monomer unit, the second rubber having at least one monomer unit different from the monomer unit which the first rubber has; a difference of absolute values of solubility parameters (SP values) between the first rubber and the second rubber being 0.2 $(J/cm^3)^{0.5}$ or larger and 4.0 $(J/cm^3)^{0.5}$ or smaller; and a ratio of tan δ1 to tan δ2, i.e. tan δ1/tan δ2 being 0.45 or larger and 2.00 or smaller, where tan δ1 is a loss factor of the first rubber composition, which is measured at a temperature of 23° C., a relative humidity of 50% and a frequency of 80 Hz, and tan δ2 is a loss factor of the second rubber composition, which is measured at a temperature of 23° C., a relative humidity of 50% and a frequency of 80 Hz is.

According to another aspect of the present disclosure, there is provided a process cartridge for electrophotography, which is detachably attachable to a main body of an electrophotographic image forming apparatus, and includes an electrophotographic photosensitive member and the above electro-conductive member.

According to further another aspect of the present disclosure, there is provided an electrophotographic image forming apparatus that includes the above electro-conductive member.

Further features of the present invention will become apparent from the following description of exemplary embodiments with reference to the attached drawings.

DESCRIPTION OF THE EMBODIMENTS

Figure 1:
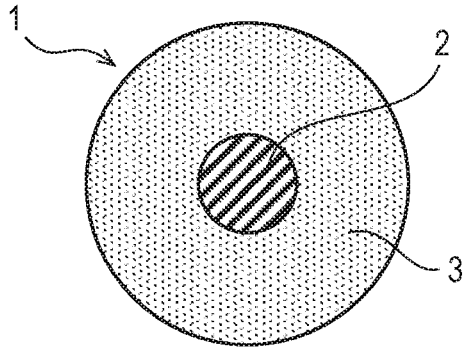
FIG. 1 illustrates a cross-sectional view perpendicular to a longitudinal direction of an electro-conductive member according to the present disclosure.

Preferred embodiments of the present invention will now be described in detail in accordance with the accompanying drawings.

According to an investigation of the present inventors, it has been recognized that the charging roller according to Japanese Patent Application Laid-Open No. 2002-3651 has a preferable structure for uniformly dispersing the electro-conductive particles in the elastic layer.

However, in the charging roller according to Japanese Patent Application Laid-Open No. 2002-3651, there has been a case where deformation (hereinafter, also referred to as "compression set") occurs which does not easily recover, in a position at which the elastic layer has abutted on another member, when the charging roller has been left in a state of having abutted on another member. When a charging roller in which the compression set has occurred in the elastic layer has been used for forming an electrophotographic image, there has been a case where a streak (hereinafter, also referred to as "unattended set streak") due to the compression set occurs in the electrophotographic image.

In other words, in the charging roller according to Japanese Patent Application Laid-Open No. 2002-3651, the particle phase of the polymer contains an electro-conductive particle such as carbon black, and accordingly the elasticity of the rubber lowers. As a result, the recoverability of the domain is low when the domain has been deformed by receiving an external force. Because of this, it is considered that the charging roller tends to easily cause the compression set.

In addition, a positional relationship between particle phases of the polymer in the elastic layer is considered to play an important role in stable discharge due to the charging roller, but the positional relationship between particle phases of the polymer has changed between the site in which the compression set has occurred in the elastic layer and the site in which the compression set has not occurred there, and it is considered that a discharge state is different between the site causing the compression set and the site causing no compression set.

For this reason, the present inventors have repeated the investigation about an electro-conductive member for electrophotography, which has an electro-conductive layer in which domains containing the electro-conductive particles are dispersed in a matrix, in order to obtain a new configuration capable of preventing the occurrence of discharge unevenness originating in the compression set.

As a result, the present inventors have found that an electro-conductive member for electrophotography, which satisfies the requirements described in the following (1) to (4), is effective in preventing the occurrence of the discharge unevenness originating in the compression set.

Requirement (1) is to have an electro-conductive support and an electro-conductive layer in this order, wherein the electro-conductive layer includes a matrix that is constituted by a first rubber composition that contains a cross-linked product of a first rubber, and a plurality of domains having electro-conductivity, which are dispersed in the matrix, wherein each of the domains is constituted by a second rubber composition that contains a cross-linked product of a second rubber and an electro-conductive particle.

Requirement (2) is that the first rubber and the second rubber are diene-based rubbers, wherein the first rubber has at least one monomer unit, and the second rubber has at least one monomer unit different from the monomer unit which the first rubber has.

Requirement (3) is that the difference of absolute values of solubility parameters (SP values) between the first rubber and the second rubber is 0.2 $(J/cm^3)^{0.5}$ or larger and 4.0 $(J/cm^3)^{0.5}$ or smaller.

Requirement (4) is that a ratio of tan δ1 to tan δ2, i.e. tan δ1/tan δ2 is 0.45 or larger and 2.00 or smaller. Here, tan δ1 is a loss factor of the first rubber composition, which is measured at a temperature of 23° C., a relative humidity of 50% and a frequency of 80 Hz, and tan δ2 is a loss factor of the second rubber composition, which is measured at a temperature of 23° C., a relative humidity of 50% and a frequency of 80 Hz.

Conventionally, the control for suppressing the deformation which occurs between the electro-conductive member and an abutting member has been mainly performed by optimizing the cross-linking form of the rubber which constitutes the electro-conductive member and by blending a filler or the like, which is contained in the rubber. In addition, it is necessary for the electro-conductive member to always make the rubber contain the electro-conductive substance, in order to achieve a uniform discharge with respect to an abutting object such as a photosensitive drum, an intermediate transfer body and a print medium. For example, when an electro-conductive particle is used as an electro-conductive substance and is contained in rubber, the elasticity of the rubber is lowered, and accordingly the recoverability from deformation deteriorates. As a result, there is a case where a detrimental effect on an image such as a set streak becomes apparent.

On the other hand, a large amount of charge transfer is required per unit time, particularly as the printing speed increases, and accordingly it is necessary to make the rubber contain a relatively large amount of electro-conductive particles. There is a case where it causes a reduction in the elasticity of the rubber that the rubber contains a large amount of electro-conductive particles and eventually causes a reduction in the recoverability from deformation.

In addition, when an external force such as a shear force which is applied to the electro-conductive member increases, the recovery of deformation cannot follow the deformation caused by the external force at the same time, and mechanical distortion continues to accumulate; and accordingly the electro-conductive member potentially tends to be easily affected by the deformation.

Accordingly, it can be said that there is a relation of trade-off between an adequate recoverability from deformation of the elastic layer and the securing of a stable discharge quantity, particularly under a high-speed process.

The present inventors have repeated investigation in order to obtain a charging member which can achieve a high level of the recoverability from the deformation and a stable discharge quantity. As a result, the present inventors have found that an electro-conductive member for electrophotography having an electro-conductive layer which satisfies the above requirements (1) to (4) contributes to solve the above problems.

The matrix is composed of the first rubber composition that contains the cross-linked product of the first rubber, and the domains are each composed of the second rubber composition that contains the cross-linked product of the second rubber and the electro-conductive particle.

In the thus formed matrix-domain structure, not only the cross-links are formed which are connected between the second rubbers constituting the domain and between the first rubbers constituting the matrix, but also the cross-links are formed at the interface between the domain and the matrix. In the cross-linking form in which these three types are combined, networks are three-dimensionally formed in the rubber constituting the electro-conductive layer, and in particular, the domain acts as a macroscopic cross-linking point. As a result of that, the electro-conductive layer can exhibit an excellent effect of suppressing the mechanical distortion against the external force.

In the electro-conductive layer, the domains are responsible for electro-conductivity. That is, electric charges are exchanged among the domains through tunnel currents at the interfaces between the matrix and the domains. Accordingly, the domain contains a large amount of electro-conductive particles, but the matrix does not substantially contain the electro-conductive particles. When an external force is applied to the electro-conductive layer having the matrix-domain structure, it is considered that a mechanical distortion is relaxed mainly in the matrix. In addition, as the domains each contains a large amount of electro-conductive particles, the domains have relatively higher hardness than that of the matrix, and therefore the domains are responsible for resisting deformation of the electro-conductive layer. Further, according to the electro-conductive member, the content of the electro-conductive particles can be greatly reduced for imparting an electro-conductivity to the electro-conductive layer which is necessary for the uniform discharge, compared to that of an electro-conductive member comprising an electro-conductive layer which does not have the matrix-domain structure.

In addition, a cross-linking reaction proceeds between the matrix and the domain, and thereby the domain acts as a macroscopic cross-linking point; and the electro-conductive member can exhibit excellent characteristics of relaxing the mechanical distortion against the external force.

The present inventors have paid attention to a chemical structure of the rubber which constitutes the domain and the matrix in the phase-separated structure, in order to progress the cross-linking reaction between the matrix and the domain and effectively relax the mechanical distortion. As a result, the present inventors have found that the rubber constituting the matrix and the domain is a diene-based rubber; and further that the rubber constituting the matrix has at least one monomer unit, and the rubber constituting the domain needs to have at least one monomer unit different from the monomer unit which is contained in the matrix.

In other words, the matrix and the domain are constituted by different rubbers from each other. This is because it enables the formation of the matrix-domain structure necessary for exhibiting the effects according to the present disclosure that the rubber constituting the domain has at least one monomer unit different from the monomer unit which is contained in the matrix.

In addition, it is because both of the rubbers constituting the matrix and the domain have a diene skeleton in the structure, thereby dissolve into each other in a part of the interface, and contribute to the enhancement of the affinity between the matrix and the domain in the interface. In addition, the diene-based rubber has a double bond in a main chain of the polymer, and accordingly has high chemical reactivity. As a result, the cross-linking reaction between the matrix and the domain proceeds, the stability of the interface is enhanced, and the electro-conductive member can exhibit excellent responsiveness to the deformation.

In addition, mechanical properties of the rubber exhibit a behavior that greatly varies depending on a frequency of the external force applied to the rubber, which is referred to generally as viscoelastic frequency characteristics.

For example, there is a case where the relaxation behavior of the mechanical distortion greatly differs between a low-frequency region such as a stationary state and a high-frequency region such as the time of rotational driving.

In order that the matrix-domain structure exhibits the effects according to the present disclosure, it is also important to approximate the viscoelastic frequency characteristics.

In the image output step, mechanical distortions in various frequency regions are applied to the electro-conductive member.

Accordingly, for example, if the viscoelastic frequency characteristics of the domain and the matrix are greatly different from each other, the relaxation behavior of the mechanical distortion is greatly different between the domain and the matrix, at the time of rotation and at the time of stoppage, and there has been a case where the discharge characteristics change along with the change of the matrix-domain structure.

As a result, there has been a case where the unattended set streak becomes apparent. It has been found that this problem occurs also in a configuration such as the present disclosure, in which the domain that contains a large amount of electro-conductive particles and is the starting point of the electric discharge resists being deformed by the external force.

It is generally known that these viscoelastic frequency characteristics are ascribed to molecular movement and accordingly depend greatly on a molecular structure of a material.

Accordingly, in order that the electro-conductive member exhibits the effects according to the present disclosure, it is an important point to design chemical structures at a molecular level and select materials constituting the domain and the matrix.

Here, the first rubber constituting the first rubber composition of the matrix has at least one monomer unit containing a diene skeleton. On the other hand, the second rubber constituting the second rubber composition of the domain has at least one monomer unit containing a diene skeleton and at least one monomer unit different from the monomer unit which the first rubber has. The monomer unit containing the diene skeleton in the second rubber may be the same monomer unit as the monomer unit that is different from the monomer unit which the first rubber has. In the case, it means that the monomer units which contain a diene skeleton in the first rubber and a diene skeleton in the second rubber, respectively, are different monomer units.

Regarding the requirement (3), the solubility parameters of the rubbers constituting the matrix and the domain are each a square root of a cohesive energy density of the molecule, and indicates a magnitude of a cohesive force between the molecules (intermolecular force).

Due to a difference between the SP values being set at 0.2 $(J/cm^3)^{0.5}$ or larger, two types of rubber materials can form a matrix-domain type phase-separated structure and stabilize the interface between the domain and the matrix. As a result, the migration of the electro-conductive particle from the domains to the matrix can be suppressed.

Due to a difference between the SP values being set at 4.0 $(J/cm^3)^{0.5}$ or smaller, the domains can be uniformly dispersed in the matrix; and as a result, the matrix-domain structure effectively disperses the external force which the electro-conductive member has received when having been slid repeatedly, and can exhibit sufficient responsiveness to deformation. Furthermore, the electro-conductive member can stably confine the electro-conductive particles in the domain, and can suppress a change of the electro-conductivity, which is caused by the agglomeration of the domains with each other. As a result, the electro-conductive member can suppress changes of the electro-conductivity at an abutting portion between the abutting member and the electro-conductive member and at a non-abutting portion.

Furthermore, regarding the requirement (4), when a viscoelastic body such as rubber or a resin has been given a stress and has been deformed, much of the given stress is stored as energy of internal deformation, and becomes a driving force for restoration when the stress has been removed. However, a part of the given stress is consumed by a friction in a molecular structure, which originates in distortion at the time when the stress has been applied, and is converted into thermal energy. A loss tangent (hereinafter, defined as tan δ) is used as a value which indicates an index of the magnitude of the internal friction.

In order to stabilize the interface between the matrix and the domain in the matrix-domain structure, a relationship between the tan δ of the domain and the tan δ of the matrix becomes important. For example, when the tan δ of the domain is remarkably different from the tan δ of the matrix, an excessive external force is selectively concentrated on only one of the domains and the matrix, and the mechanical distortion is excessively accumulated in the domains or the matrix. As a result, there is a case where domains agglomerate with each other, and the agglomeration of the domains may unstabilize the exchange charges among the domains.

Actually, when the tan δ of the domain is greatly different from the tan δ of the matrix, the domains agglomerate with each other only at the abutting portion, and a difference of the discharge quantity is caused between the abutting portion and the non-abutting portion: and there has been a case where an unattended set streak has occurred.

Further, tan δ of matrix and tan δ of the domain tend to be different from each other at the time when an application and removal of an external force to those is carried out at high frequency. Thus, the requirement (4) defines a ratio of a responses to deformation of the domain and the matrix at a frequency of 80 Hz which corresponds to the case of which an application and removal of an external force to the domain and the matrix is carried out at high frequency. When tan δ1/tan δ2 is in the range of 0.45 to 2.00, even when an application and removal of an external force to the electro-conductive member at high frequency, distortion is hard to be accumulated only in the domain or the matrix, and therefore the interface between the domain and the matrix is more stabilized.

This tan δ is controlled by a material of the rubber, the type and amount of a filler contained in the rubber, and the cross-linking form. The responsiveness to the deformation, which is represented by tan δ, is characterized by that the responsiveness greatly varies depending on a frequency of repetition of the application and removal of the stress, in other words, a frequency of the deformation and the restoration. In a process cartridge and an electrophotographic image forming apparatus which are equipped with the electro-conductive member, it is necessary to consider the deformation and the restoration in various frequency regions such as a frequency of a vibration which is generated during sliding, and a frequency which is specific to a driving system such as a gear and a motor. Furthermore, in the image output step, mechanical distortions in various frequency regions are applied to the electro-conductive member. Accordingly, for example, if the viscoelastic frequency characteristics of the domain and the matrix are greatly different from each other, a relaxation behavior of the mechanical distortion is greatly different between the domain and the matrix, at the time of rotation (high-frequency region) and at the time of stoppage (low-frequency region), and there has been a case where a change of the discharge characteristics is caused along with the change of the matrix-domain structure.

In the present disclosure, materials of the domain and the matrix are each selected from a diene-based rubber having a diene skeleton in the chemical structure. Due to the existence of this diene skeleton, the matrix-domain structure can not only facilitate approximation of a value of the tan δ, but also reduce a difference between frequency dependencies of the tan δ.

From the above reason, the matrix-domain structure effectively disperses the stress even though the sliding has been repeated under a high-speed process, and contributes to the stabilization of the interface between the domain and the matrix. As a result, the matrix-domain structure exhibits the effects according to the present disclosure.

An electro-conductive member having a roller shape (hereinafter, also referred to as "electro-conductive roller") shall be taken up as an example of an embodiment of the electro-conductive member for electrophotography according to the present disclosure, and will be described below in detail.

FIG. 1 illustrates a cross-sectional view perpendicular to the longitudinal direction of the electro-conductive roller 1. The electro-conductive roller 1 has a columnar or hollow cylindrical electro-conductive support 2 having electro-conductivity, and an electro-conductive layer 3 that is formed on the outer circumference of the electro-conductive support.

Figure 2:
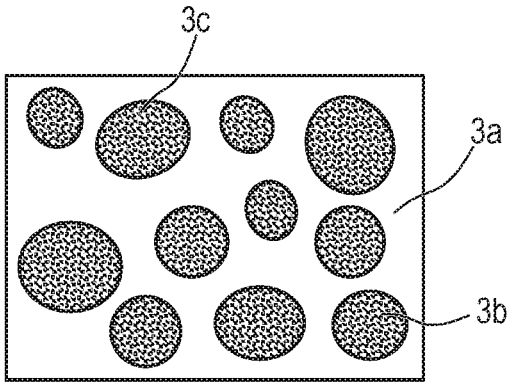
FIG. 2 illustrates a cross-sectional view perpendicular to a longitudinal direction of an electro-conductive layer of the electro-conductive member according to the present disclosure.

FIG. 2 illustrates a cross-sectional view perpendicular to the longitudinal direction of the electro-conductive layer of the electro-conductive roller. The electro-conductive layer 3 has a matrix-domain structure which contains a matrix 3*a* serving as a sea region and a domain 3*b* serving as an island region. In addition, the electro-conductive particles 3*c* are unevenly distributed in the above domain 3*b*.

<Method of Confirming Matrix-Domain Structure>

The matrix-domain structure can be confirmed in the following way.

Specifically, a slice may be produced from the electro-conductive layer of the electro-conductive member, and observed in detail. Examples of a unit for producing the slice include a sharp razor, a microtome and an FIB. In addition, in order to suitably observe the matrix-domain structure, the slice may be subjected to the pretreatment such as dyeing treatment or vapor deposition treatment, by which a contrast between an electro-conductive phase and an insulative phase can be suitably obtained. The slice on which the fracture cross section has been formed and which has been subjected to the pretreatment can be observed with a laser microscope, a scanning electron microscope (SEM), or a transmission electron microscope (TEM).

<Electro-Conductive Support>

A material constituting an electro-conductive support can be appropriately selected from materials which are well known in the field of electro-conductive members for electrophotography. Examples of the materials include: metals such as aluminum and iron; alloys such as copper alloys and stainless steel; and resin materials having electro-conductivity. Furthermore, these materials may be subjected to oxidation treatment, or plating treatment with chromium, nickel or the like. Any of electroplating or electroless plating can be used as the plating method, but electroless plating is preferable from the viewpoint of dimensional stability. Examples of the types of electroless plating to be used here include nickel plating, copper plating, gold plating, and plating with other various alloys. The plating thickness is preferably 0.05 μm or larger, and in consideration of a balance between work efficiency and rust prevention ability, the plating thickness is preferably 0.1 to 30 μm. Examples of the shape of the electro-conductive support include a columnar shape and a hollow cylindrical shape. The outer diameter of the electro-conductive support is preferably in a range of 3 mm to 10 mm.

<Electro-Conductive Layer>

<<Matrix>>

The matrix includes a first rubber having at least one monomer unit. In addition, the matrix has a relatively high volume resistivity compared to that of the domain. In other words, the content of the electro-conductive particle is relatively low in the matrix compared to that in the domain, and accordingly the matrix can exhibit excellent elasticity of the rubber compared to the domain.

[First Rubber Composition]

The first rubber composition is not particularly limited as long as the composition is a diene-based rubber, contains a cross-linked product of a first rubber which is different from the second rubber, satisfies the above difference between the SP values, and can form a matrix of a matrix-domain structure. Here, the diene-based rubber is defined as a rubber having a double bond in a main chain of a polymer.

On the other hand, when the main chain of the polymer does not have a double bond, or even though the main chain has a double bond, when the amount is very small, the rubber is defined as a non-diene rubber. For example, an ethylene-propylene-diene ternary copolymer (EPDM) of which the raw material monomer contains diene is not included in the diene-based rubber, because the diene is consumed by the addition reaction and does not remain.

In addition, butyl rubber (IIR) which is a rubber obtained by polymerizing isobutylene and a small amount of isoprene at a low temperature is classified as a non-diene rubber, because a double bond derived from isoprene is very few.

It is also possible to blend a reinforcing carbon black to the matrix as a reinforcing agent, to such an extent as not to affect the recoverability from deformation of the first rubber. Examples of the reinforcing carbon black which is used here include FEF, GPF, SRF and MT carbon, of which the electro-conductivity is low and of which the surface area is small.

Furthermore, into the first rubber which forms the matrix, generally used blending agents for rubber may be added, which include a filler, a processing aid, a vulcanization accelerating aid, a vulcanization retarder, an antioxidant, a softener, a dispersant and a coloring agent, as needed, to such an extent as not to impair the recoverability from deformation.

<<Domain>>

The domain is constituted by a second rubber composition that contains a cross-linked product of the second rubber, and the electro-conductive particle. The domain contains the electro-conductive particle, and thereby exhibits the electro-conductivity. Here, the electro-conductivity means that the volume resistivity is lower than $1.0\times10^{8}$ Ω·cm.

<Second Rubber>

The second rubber has a monomer unit different from that of the first rubber. In addition, the second rubber is not particularly limited as long as the second rubber has an absolute value of the SP value which is different from that of the first rubber in a range of 0.2 $(J/cm^3)^{0.5}$ or larger and 4.0 $(J/cm^3)^{0.5}$ or smaller, and can form a phase-separated structure. The second rubber used is selected from diene-based rubbers, similarly to the first rubber.

<Selection of First and Second Rubber>

Materials of the domain and the matrix which constitute the electro-conductive layer will be described below in detail. A dominant factor which determines the matrix-domain structure and the characteristics of relaxing the mechanical distortion is a combination of the rubbers contained in the matrix and the domain.

The rubber materials which the domain and the matrix contain mean the first rubber contained in the first rubber composition constituting the matrix and the second rubber contained in the second rubber composition constituting the domain.

The first rubber and the second rubber are selected from diene-based rubbers so that the first and second rubbers satisfy the difference between the SP values in the above requirement (3). Usable examples of such diene-based rubbers include isoprene rubber (IR), acrylonitrile-butadiene rubber (NBR), styrene-butadiene rubber (SBR), butadiene rubber (BR) and chloroprene rubber (CR). The SP values of the first and second rubbers can be controlled by adjusting the selection of materials, the selection of a copolymerization ratio of segments containing a monomer unit derived from styrene in the case of SBR, and a monomer unit derived from acrylonitrile in the case of NBR, and/or the like.

The SBR is a copolymer of styrene and butadiene. It is preferable that a content ratio (styrene content) of the monomer unit derived from styrene in the SBR is 18% by mass or larger and 40% by mass or smaller. SBR can easily control its SP value by a polymerization ratio of styrene unit. When the content of the styrene unit is controlled to 18% by mass or larger, the SBR can have an SP value for having an appropriate difference of an SP value of the NBR of which the polarity is relatively high. When the content of the styrene unit is controlled to 40% by mass or smaller, it is possible to suppresses an excessive rise of the SP value of the SBR. In addition, the monomer units having a diene skeleton sufficiently exist in the matrix, which accordingly facilitates the approximation of the viscoelastic characteristics of the domain and the matrix. Furthermore, the affinity between the matrix and the domain is sufficiently obtained at the interface, which can increase the amount of the chemical bonds between the matrix and the domain.

The styrene content in the SBR can be quantified with the use of a well-known analytical method such as pyrolysis gas chromatography (Py-GC) or solid-state NMR.

The NBR is a copolymer of acrylonitrile and butadiene. It is preferable that a content ratio of the monomer unit derived from acrylonitrile (nitrile content) is 18% by mass or larger and 40% by mass or smaller. When the content of nitrile is 18% by mass or larger, the NBR can form an appropriate difference between the SP value of the NBR and the SP values of polyisoprene and SBR of which the polarities are relatively low. On the other hand, when the content is 40% by mass or smaller, the NBR takes effects in the stabilization of the interface between the matrix and the domain, in the uniformalization of the domains, and in the approximation of the viscoelastic frequency characteristics, due to the same reason as in the above SBR. Furthermore, the affinity between the matrix and the domain is sufficiently obtained at the interface.

The nitrile content can be quantified with the use of a well-known analytical method such as Py-GC or solid-state NMR, similarly to the quantification of the styrene content in the SBR.

In addition, isoprene rubber (IR) is a diene-based rubber which is derived from a hydrocarbon and has two double bonds in the structure. As the isoprene rubber, 1,2-polyisoprene, 1,3-polyisoprene, 3,4-polyisoprene, and cis-1,4-polyisoprene, trans-1,4-polyisoprene, copolymers thereof and the like can be selected. These chemical structures and copolymerization ratios can be specified with the use of NMR which is a well-known analytical method. The isoprene rubber, when being used, can form an appropriate difference between the SP value of the isoprene rubber and the SP values of BR, CR, NBR and SBR of which the polarities are relatively high. In addition, the monomer units having a diene skeleton sufficiently exist in the structure, which accordingly facilitates the approximation of the viscoelastic frequency characteristics of the domain and the matrix. Furthermore, the affinity between the matrix and the domain is sufficiently obtained at the interface, which can increase the amount of the chemical bonds between the matrix and the domain.

The chloroprene rubber (CR) can be controlled by the selection of mercaptan modification or sulfur modification, the content of monomer units derived from 2,3-dichloro-1,3-butadiene, and the like. The chemical structures and copolymerization ratios of IR and CR can be specified with the use of the NMR which is the well-known analytical method.

It is preferable that the first rubber and the second rubber are each independently selected from isoprene rubber, NBR, SBR and butadiene rubber, among the above diene-based rubbers. In addition, when the first rubber is NBR, it is preferable that the second rubber is selected from any one of SBR and isoprene rubber. Furthermore, when the first rubber is SBR, it is preferable that the second rubber is selected from any one of NBR and isoprene rubber. An important point for exhibiting the effects according to the present disclosure is to achieve both of the formation of the interface between the matrix and the domain and the enhancement of reactivity at the interface. As described above, a combination of the NBR and the SBR can easily control the SP values by the nitrile content and the styrene content, respectively. As a result, the combination can realize suppression of the migration of the electro-conductive particle in the domain and uniform formation of the domain due to the control of the difference between the SP values. In addition, since the diene skeleton exists in both of the first rubber and the second rubber, at the time when the matrix-domain structure is being formed, the interface between the first rubber and the second rubber tend to compatible each other. As a result of that, domains and the matrix chemically bonded at the interface therebetween, and therefore, even when large external force is applied to the electro-conductive layer, a breakage of the matrix-domain structure can be effectively suppressed. Furthermore, a part of the chemical structure of the main component of the rubber which constitutes the domain and the matrix is equal at the molecular level, which can achieve approximation of the viscoelastic frequency characteristics at a high-dimensional level.

<Method for Measuring SP Value>

The SP values of the first and second rubbers can be calculated accurately by creating a calibration curve using a material of which the SP value is known. As the known SP value, a value in a catalog of a material maker can be used. For example, the SP values of NBR and SBR do not depend on the molecular weight, and are determined by content ratios of the monomer unit derived from acrylonitrile and the monomer unit derived from styrene, respectively. Accordingly, the SP values can be calculated from calibration curves that are obtained from the materials of which the SP values are known, respectively, based on an analysis of the nitrile content and the styrene content in the rubbers constituting the matrix and the domain, with the use of an analytical method such as Py-GC and solid-state NMR. In addition, the SP value of isoprene is determined according to structures of 1,2-polyisoprene, 1,3-polyisoprene, 3,4-polyisoprene, and cis-1,4-polyisoprene, trans-1,4-polyisoprene, and the like. Accordingly, the SP value can be calculated from a material of which the SP value is known, based on the analysis of the content ratio of the structure of an isoprene isomer by Py-GC, solid-state NMR or the like, in a similar way to those in SBR and NBR.

<Method for Measuring Tan δ>

The tan δ1 of the first rubber composition that contains a cross-linked product of the first rubber constituting the matrix, and the tan δ2 of the second rubber composition that contains a cross-linked product of the second rubber and an electro-conductive particle, which constitute the domain, can be measured with the use of a well-known dynamic viscoelasticity measurement apparatus. The measurement samples are produced by operations of: separately weighing each of the raw rubbers that constitutes the matrix and the domain, the electro-conductive particle, the filler and the like; separately subjecting the materials to rubber kneading treatment; adding a vulcanizing agent/a vulcanization accelerator at the same ratios as the rubber compositions for molding of the electro-conductive member; and vulcanizing the resultant rubbers. Specifically, a rubber sheet having a thickness of 2 mm can be obtained by placing each of an unvulcanized rubber composition for the domain and an unvulcanized rubber composition for the matrix to which a vulcanizing agent has been added in a mold having a thickness of 2 mm; and cross-linking the composition at 10 MPa and 170° C. for 60 minutes. This sample is each measured in a tensile test mode or a compression test mode, and the tan δ1 and tan δ2 can be measured.

<Viscoelastic Frequency Characteristics>

As described above, in order to prevent the domains from aggregating in the electro-conductive layer, tan δ1/tan δ2 of which tan δ1 and tan δ2 have been measured at 80 Hz under an environment of a temperature of 23° C. and a relative humidity of 50% is necessary to be in the range of from 0.45 to 2.00.

<Electro-Conductive Particle>

Examples of the electro-conductive particle include carbon materials such as carbon black and graphite; oxides such as titanium oxide and tin oxide; metals such as Cu and Ag; particles of which the surfaces are coated with an oxide or a metal and are made electro-conductive.

In addition, two or more of these electro-conductive particles may be appropriately combined and blended, as needed.

Among the materials, the electro-conductive carbon black is preferable by reasons of; having high efficiencies in suppressing the great lowering of the elasticity of the rubber and in making the electro-conductive layer electro-conductive; having high affinity with the rubber; facilitating the control of a distance between electro-conductive particles, and the like.

The type of the electro-conductive carbon black is not particularly limited. Specific examples thereof include gas furnace black, oil furnace black, thermal black, lamp black, and acetylene black.

In addition, the amount of the electro-conductive particles in the domain is preferably 30 to 200 parts by mass, more preferably 50 to 150 parts by mass, per 100 parts by mass of the second rubber. The domain containing the electro-conductive particles in an amount as stated above, is relatively harder than the matrix, and therefore the domain can resist being deformed when an external force is applied. As a result of that, it is possible to prevent the domains from accumulating a mechanical distortion. In addition, an excessive decrease of the elasticity of the domain, can be prevented, and therefore it is possible for the domain to maintain sufficient followability to the deformation. As a result of that, agglomeration of the domains can be prevented even when an external force has been repeatedly applied to the electro-conductive layer. Further, since the electro-conductive particles can stably exist in the domain, the domain suppresses the migration of the electro-conductive particles (electro-conductive carbon black) to the matrix, and makes it easy to exhibit the effects according to the present disclosure. In addition, when the amount of the electro-conductive particles to be blended is in the above range, the domain has a sufficient electro-conductivity.

Furthermore, when the average value of ratios of the cross-sectional area of the electro-conductive carbon black contained in each domain to each cross-sectional area of the domains appearing in the cross section in the thickness direction of the electro-conductive layer is defined as μ, it is preferable that the μ is 20% or larger and 40% or smaller.

As for the amount of and a ratio of area occupied by the electro-conductive carbon black to be blended, the electro-conductive member for general electrophotography is characterized in that the electro-conductive carbon black is blended in a large amount. The electro-conductivity of the carbon black is formed by a tunnel current which flows between carbons. This dispersion of the amount of the tunnel currents correlates with the distribution of the distances between carbon particles. Therefore, along with the increase of the amount of and the ratio of area occupied by the electro-conductive carbon black to be added which is contained in the domain, the distribution of the distances between the carbons becomes more uniform, which can suppress the dispersion. Accordingly, when the average value of the ratios of the cross-sectional areas is in the above range, uniform discharge can be facilitated.

When the μ is 20% or larger, the amount of the electro-conductive carbon black is sufficient, and the electrical connection between the carbon blacks in the domain becomes stable like percolation. Because of this, it becomes difficult that a difference of the discharge quantity is caused between the abutting portion and the non-abutting portion, and the unattended set streak becomes less likely to occur. In addition, when the μ is 40% or smaller, the electro-conductive carbon black exists in the domain in a more stable state, and the migration of the electro-conductive carbon black to the matrix can be more reliably prevented.

As for the electro-conductive carbon black to be blended in the domain, carbon black that has a surface of which the pH is as neutral as 6.0 or higher is particularly preferable. Furthermore, it is particularly preferable that a DBP absorption of the electro-conductive carbon black to be blended in the domain is 85 $cm^3$/100 g or more and 160 $cm^3$/100 g or less. For information, the DBP absorption of the carbon black can be measured according to JIS K6217. Alternatively, a value in a maker catalog may be used. When the electro-conductive carbon black is used of which the pH is 6.0 or higher and the DBP absorption is 85 $cm^3$/100 g or more and 160 $cm^3$/100 g or less, the electro-conductive layer can keep a resistance value in a proper range even though having a domain structure. Furthermore, the above electro-conductive carbon black can exhibit excellent affinity with the diene-based rubber. Because of this, the electro-conductive carbon black interacts with the second rubber, and thereby can suppress the agglomeration of the domains with each other even at the time of the relaxation behavior of the distortion after the electro-conductive member has repeatedly received the external force. As a result, the electro-conductive member suppresses the change in the discharge quantity at the abutting portion on the abutting member, which is particularly susceptible to the mechanical distortion, and can easily suppress the unattended set streak.

<Vulcanizing Agent/Vulcanization Accelerator>

In order to obtain a cross-linked product of the first rubber and a cross-linked product of the second rubber, the electro-conductive layer can employ a vulcanizing agent and a vulcanization accelerator. The vulcanizing agent is not particularly limited, and can employ sulfur, metal oxides, peroxides and the like. Among these vulcanizing agents, sulfur is more preferable from a viewpoint that the sulfur molecule bonds a molecular chain with a molecular chain to form a net-like molecular structure, and thereby can increase the amount of chemical bonds at the matrix-domain interface. Due to the electro-conductive layer being cross-linked by the use of sulfur, the three-dimensional network-like cross-links are formed also in the matrix-domain structure due to the sulfur molecule that bonds a molecular chain with a molecular chain, which facilitates an increase of the amount of chemical bonds at the interface between the matrix and the domain.

In addition, a master batch type of vulcanizing agent can be preferably used in which a vulcanizing agent is kneaded into a small amount of the first rubber and/or the second rubber. The use of the master batch type of vulcanizing agent facilitates the uniform dispersion of the vulcanizing agent into a raw rubber material. In addition, the master batch type of sulfur can be suitably used in which sulfur is kneaded into a small amount of the first rubber and/or the second rubber. The use of the master batch type of sulfur facilitates uniform dispersion of the sulfur into a raw rubber material. As a result, the master batch type of sulfur suppresses the uneven distribution of sulfur, increases the amount of chemical bonds at the interface of the matrix-domain structure, and thereby makes it easier to stabilize the interface. Two or more of the master batch type of sulfurs may be mixed at an arbitrary ratio, so as to fit the material constituting the domain and the matrix structure, and the blending ratio. For example, when the cross-linked product of the first rubber and the cross-linked product of the second rubber are blended at ratios of 70% by mass and 30% by mass, respectively, the master batch type of sulfurs of the first and second rubbers are added at ratios of 70% by mass and 30% by mass, respectively, which thereby can form more uniform cross-links. It is preferable that the amount of sulfur to be blended is in a range of 0.5 to 7 parts by mass per 100 parts by mass of an unvulcanized rubber component in the electro-conductive layer (100 parts by mass in total of first and second rubbers), from the viewpoint of uniformly proceeding cross-linking and suppressing bloom. The amount of the sulfur is more preferably 1 to 4 parts by mass.

In addition, it is important to greatly reduce the vulcanization time period by using a vulcanization accelerator in combination with a vulcanizing agent, in order to form the cross-links at the interface. In particular, in a system in which two rubbers are blended as in the present disclosure, there is a case where a necessary time period for vulcanization varies between the two rubbers.

At this time, a difference of mobility is caused between fillers or vulcanizing agents such as sulfur which exist in the rubbers, due to a difference between melt viscosities of the rubbers. Specifically, it becomes easy for fillers and vulcanizing agents to be unevenly distributed, from rubber in which the vulcanization easily proceeds, to rubber in which the vulcanization resists proceeding. As a result, because of the uneven distribution of the vulcanizing agent, the amount of chemical bonds decreases at the interface of the matrix-domain type structure, and the interface becomes unstable. Accordingly, the combined use of the vulcanization accelerator reduces the vulcanization time period, thereby suppresses the uneven distribution of the vulcanizing agent, and can promote the cross-linking at the interface between the matrix and the domain.

The vulcanization accelerator is not particularly limited, and usable examples include the vulcanization accelerators illustrated in the following: aldehyde-ammonia base, aldehyde-amine base, thiourea base, guanidine base, thiazole base, sulfenamide base, thiuram base, dithiocarbamate base, xanthate base, and a mixture accelerator thereof. Among the examples, in particular, it is preferable that the rubbers contain a thiazole-based compound. It is more preferable that the rubbers contain a sulfenamide-based compound. The examples include N-tert-butyl-2-benzothiazolyl sulfenamide, and N-cyclohexyl-2-benzothiazole sulfenamide.

A solubility ratio of the vulcanization accelerator varies, which is an indicator of the affinity with rubber, depending on the chemical structure. In general, this solubility ratio correlates with the difference between SP values of the vulcanization accelerator and the rubber to be mixed, and accordingly varies depending on the type of rubber, in other words, on the SP value of the rubber. Specifically, the optimum blend of the vulcanization accelerator varies depending on the chemical structure of the rubber. The thiazole-based compound has almost the same solubility ratio to butadiene rubber, chloroprene rubber, isoprene rubber, SBR and NBR which are preferable materials constituting the domain and the matrix as in the present disclosure, and makes it easy to uniformly disperse the vulcanization accelerator into the raw rubber material. As a result, the vulcanizing agent and the vulcanization accelerator can be uniformly dispersed in the electro-conductive layer, in combination with the effect of suppressing the uneven distribution of the vulcanizing agent due to shortening of the vulcanizing time period. Along with the above uniform dispersion, the cross-linking proceeds uniformly inside each of the domain and the matrix, and at the same time, the amount of chemical bonds at the interface increases. As a result, the thiazole-based compound can form three-dimensional network-like cross-links which can exhibit the effect of suppressing the mechanical distortion at a high-dimensional level, when the external force has been applied, in combination with the effects of the requirements (1), (2) and (3).

Furthermore, other vulcanization accelerators which have been illustrated in the above can be used together with the vulcanization accelerator of the thiazole-based compound. As the vulcanization accelerator to be used together, a vulcanization accelerator is particularly preferable which is selected from thiuram-base and thiourea-base. When these vulcanization accelerators are used together, the vulcanization time period can be easily adjusted. As a result, the combined use suppresses uneven distribution of the vulcanizing agent, and can promote the cross-linking at the interface between the matrix and the domain.

<Method for Analyzing Cross Linked Rubber>

The presence or absence of cross linked rubber of the first and second rubbers in the electro-conductive layer may be analyzed by well-known analytical methods such as pyrolysis gas chromatography (Py-GC), solid nuclear magnetic resonance spectroscopy (NMR method) and Raman spectroscopy. In the Raman spectroscopy, the presence or absence of the sulfur cross-link in SBR can be determined. In the Raman spectrum, peaks originating in the sulfur cross-links of SBR are detected in positions of 438 $cm^{-1}$, 475 $cm^{-1}$ and 509 $cm^{-1}$, and accordingly sulfur cross-linked structure can be directly detected by the presence or absence of the peaks. In addition, the presence or absence of the sulfur cross-links in NBR and isoprene rubber can be determined with the use of Py-GC. A sample is pyrolyzed at a temperature in a range of 550° C. to 600° C., and the formed pyrolysis product is separated by a separation column, and the resultant product is detected by a hydrogen flame ionization detector, and the pyrogram is obtained. Furthermore, pyrograms of carbon and sulfur are obtained by measuring the sample under the same condition, and detecting carbon and sulfur by an atomic emission detector; the peaks are identified with the use of mass spectrometry; and thereby the presence or absence of the sulfur cross-link can be determined.

<Method for Identifying Vulcanization Accelerator>

The vulcanization accelerator contained in the cross-linked products of the first and second rubbers in the electro-conductive layer exists in a state of a low molecular weight because the vulcanization accelerator has been decomposed or the structure has changed in a process of the vulcanization, and accordingly can be identified by analysis with a head-space gas-chromatographic method. Specifically, 100 mg of the electro-conductive layer is batched off, and is set in a headspace sampler; and the volatile component is purged, and is trapped in an adsorbing agent. Next, the volatile component is thermally desorbed by Curie point heating, the resultant volatile component is analyzed by GC/MS, and thus the chemical structure of the vulcanization accelerator can be analyzed. In addition, the amount of the vulcanization accelerator to be blended can also be analyzed by subjecting the vulcanization accelerator to a well-known quantitative analysis such as a sodium sulfide method, a cyanamide method, a hydrogen iodide reduction method, a sodium sulfite method and an amine method.

<Volume Fraction of Domain>

It is preferable that the volume fraction of the domain in the electro-conductive layer is 10% by volume or higher and 40% by volume or lower. By the volume fraction being controlled to 10% by volume or higher, a sufficient amount of the matrix-domain interfaces can be formed, and makes it easy that the domains exhibit a function of a macroscopic cross-linking point. As a result, the electro-conductive layer can exhibit an excellent effect of suppressing the mechanical distortion against the external force. In addition, the volume fraction can suppress an excessive addition of the electro-conductive particle in the domain. As a result, the electro-conductive layer can suppress an excessive decrease of the elasticity of the rubber in the domain, and can exhibit sufficient followability to the deformation of the domain and the matrix; and accordingly, can suppress the agglomeration of the domains with each other, even when the external force has been repeatedly applied thereto.

On the other hand, by the volume fraction being controlled to 40% by volume or smaller, the electro-conductive layer can suppress the agglomeration of the domains with each other when the external force has been applied and when the mechanical distortion has been relaxed, and makes it easy to suppress a change of discharge characteristics. In addition, the electro-conductive layer can have a structure in which the matrix is relatively much with respect to the domain, and accordingly can make a matrix excellent in the elasticity of the rubber to exhibit the recoverability from the deformation. Furthermore, the volume fraction suppresses an excessive increase of the number of interfaces between the domain and the matrix; and thereby the electro-conductive layer can effectively disperse the stress, when having been repeatedly slid, and thereby makes it easy to exhibit the effects according to the present disclosure.

<Method for Measuring Volume Fraction of Domain>

The volume of the domains can be determined from a three-dimensional (3D) image of the domain by using FIB-SEM.

The FIB-SEM is a technique of working a sample with an FIB (Focused Ion Beam: focused ion beam) apparatus and observing an exposed cross section with an SEM (scanning electron microscope: scanning electron microscope). The 3D image of the domain can be created by obtaining large number of cross-sectional images of the electro-conductive layer, and re-construct 3D image of the electro-conductive layer from the cross-sectional images by using computer software.

Figure 3:
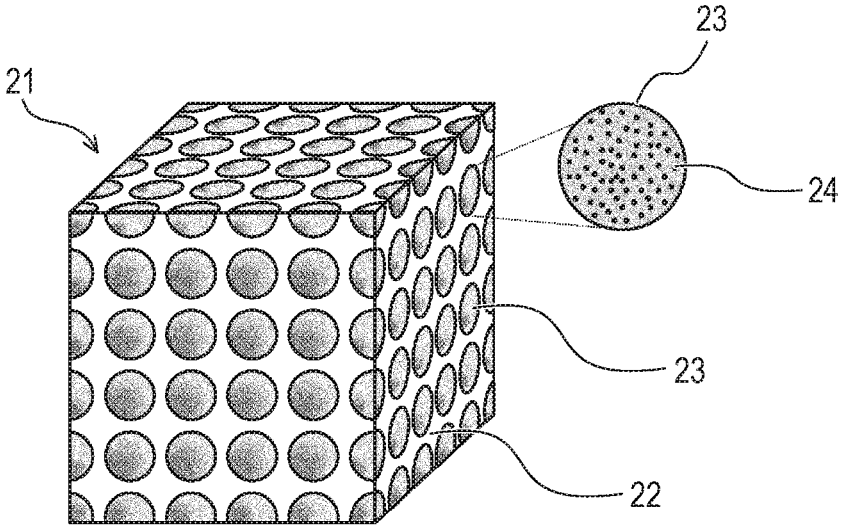
FIG. 3 illustrates a three-dimensional solid figure of an electro-conductive layer according to the present disclosure.

As for a specific method for measuring the domain volume, a three-dimensional stereoimage represented by FIG. 3 has been obtained with the use of the FIB-SEM (manufactured by FEI company Ltd.) (as described above in detail), and from the image, the above configuration has been confirmed. In FIG. 3, domains 23 are scattered in a matrix 22, in a cubic shape 21 of which one side is 9 μm. The domain 23 contains electro-conductive particles 24 in a form of being dispersed. Note that the size and arrangement of the domains 23 are not limited to those illustrated in the schematic perspective view of FIG. 3.

Samples are taken out from an arbitrary nine portions of the electro-conductive layer; and in the case of the roller shape, when the length in the longitudinal direction is determined to be 1, the samples are cut out from the vicinities of three portions which are (¼)l, (⅔)l and (¾)l from the end, at every 120 degrees in the circumferential direction of the roller, respectively.

After that, the samples are subjected to three-dimensional measurement with the use of the FIB-SEM, and an image of a cubic shape of which one side is 9 μm is measured at intervals of 60 nm. Here, the cross sections of the electro-conductive layer in each of the (¼)l, (⅔)l and (¾)l cross sections are measured at every 90 degrees in the circumferential direction of the roller, at central portions between the core metal position and the surface, respectively.

In addition, it is also preferable to subject the sample to pretreatment by which the contrast between the domain and the matrix can be suitably obtained, in order that the domain structure is suitably observed. Here, dyeing treatment can be preferably used.

After that, the obtained image is analyzed with the use of 3D visualization/analysis software Avizo (registered trademark, manufactured by FEI Company, Ltd.), and the volumes of the domains in 27 pieces of unit cubes of which one side is 3 μm are calculated, which are contained in one sample of a cubic shape of which one side is 9 μm.

In addition, the distance between the adjacent wall surfaces of the domains can be measured in the same manner with the use of the above 3D visualization/analysis software, and after the above measured values have been obtained, the distance can be calculated from the arithmetic average of the 27 samples in total.

<Domain Size>

It is preferable that the size of the domain is in a range of 0.1 μm to 4 μm. It is more preferable that the size is in a range of 0.2 μm to 2 μm. By having the size controlled to 0.1 μm or larger, the domain suppresses the movement of the electro-conductive particles from the domain to the matrix, and can suppress the decrease of the elasticity of the rubber in the matrix. In addition, the size makes it easy that the domains exhibit a function of a macroscopic cross-linking point. As a result, the electro-conductive layer can exhibit an excellent effect of suppressing the mechanical distortion against the external force. Furthermore, the electro-conductive layer can suppress a change of the electro-conductivity, which is caused by the agglomeration of the domains with each other. As a result, the electro-conductive member makes it easy to suppress changes of the electro-conductivity at an abutting portion between the abutting member and the electro-conductive member and at a non-abutting portion. On the other hand, by having the size controlled to 4 μm or smaller, the domain exhibits an effect of transporting an electric charge due to a tunnel current even under a high-speed process, and can suppress poor charging. In addition, the electro-conductive layer can suppress a change of the discharge quantity, which is caused by the agglomeration of the domains with each other. Furthermore, by having the size controlled to 2 μm or smaller, the domain suppresses the decrease of the area of the interface between the domains and the matrix, and makes it easy that the domains exhibit a sufficient function as a macroscopic cross-linking point. As a result, the electro-conductive layer can exhibit an excellent effect of suppressing the mechanical distortion against the external force.

<Method for Measuring Domain Size>

The measurement of the domain size may be implemented in the following way. First, a slice is produced by a method similar to the above method for confirming the matrix-domain structure. Next, a fracture cross section can be formed by a unit such as a freezing fracture method, a cross polisher method or a focused ion beam method (FIB). Considering the smoothness of the fracture cross section and pretreatment for observation, the FIB method is preferable. In addition, in order to suitably observe the matrix-domain structure, the slice may be subjected to the pretreatment such as dyeing treatment or vapor deposition treatment, by which a contrast between an electro-conductive phase and an insulative phase can be suitably obtained.

The slice on which the fracture cross section has been formed and the pretreatment has been performed can be observed with a laser microscope, a scanning electron microscope (SEM), or a transmission electron microscope (TEM). Among the microscopes, it is preferable to observe the slice with the SEM at a magnification of 1000 to 100000 in view of the correctness of the quantification of the area of the electro-conductive phase.

The domain size can be obtained by quantifying the captured image in the above description. An image processing software such as Image Pro Plus (registered trademark, manufactured by Media Cybernetics, Inc.) is used to convert the image of the fracture cross section, which has been obtained by observation with the SEM, into an 8-bit gray scale, and a 256-gradation monochrome image is obtained. Next, black and white portions of the image are reversed so that the domain in the fracture cross section becomes white, and the binarization is performed. Next, the arithmetic average value may be obtained by calculating diameters of circle-equivalent diameters from area values of the domain size group in the image, respectively.

The above domain size may be measured by dividing the electro-conductive member into four parts in the circumferential direction and five parts in the longitudinal direction, cutting out one slice sample at an arbitrary portion in each of the divided regions, performing the above measurement to obtain 20 points of measured values in total, to calculate the domain size from the arithmetic average of the measured values.

<Distance Between Domains>

The distance between the domains is defined by a distance of an insulative phase (matrix) sandwiched between the electro-conductive phases (domains). A range of the distance between the domains is 0.2 μm or larger and 2 μm or smaller. The distance between the domains, which is controlled to 0.2 μm or larger, can make it easy to suppress the agglomeration of the domains with each other. By the distance being controlled to 2 μm or smaller, an area can be sufficiently obtained in which the cross-links are formed between the domains and the matrix. As a result, the effect of the three-dimensional network can be sufficiently obtained in which the domain functions as a macroscopic cross-linking point, which accordingly makes it easy to exhibit an excellent effect of suppressing the mechanical distortion against the external force.

<Method for Measuring Distance Between Domains>

The distance between the domains can be measured by observing a cross section of the electro-conductive layer in the same manner as the measurement method of the domain size.

The distance between the wall surfaces of the domain group in the image is calculated with the use of the image processing software, after the image of the fracture cross section has been binarized in the same method as in the above method for measuring the domain size. The distance between the wall surfaces at this time is the shortest distance between the wall surfaces of the domains which are positioned most closely among the adjacent domains. The above distance between the domains may be measured by dividing the electro-conductive member into four parts in the circumferential direction and five parts in the longitudinal direction, cutting out one slice sample at an arbitrary portion in each of the divided regions, performing the above measurement to obtain 20 points of measured values in total, to calculate the distance between the domains from the arithmetic average of the measured values.

<Uniformity of Arrangement of Domains>

It is preferable that the domains in the matrix-domain structure are uniformly arranged. Specifically, the distribution of the distances among the centers of gravity of the domains is 0 or more and 0.4 or less. By the distribution being controlled to 0.4 or less, the dispersion of the distances between domains can be reduced. Thereby, the bias of the mechanical distortion with respect to the domain and the matrix can be suppressed, which accordingly makes it easy to efficiently relax the mechanical distortion. In addition, the agglomeration of the domains with each other occurs from a portion at which the distance between the domains is closest to each other; and accordingly due to suppression of the dispersion of the distances between the domains, it becomes easy to suppress the agglomeration of the domains with each other, and it also becomes easy to exhibit uniform discharge characteristics.

The uniformity of the arrangement of the domains may be measured in the following way. First, putting three observation square areas on a thickness region of 0.1 T to 0.9 T from an outer surface of the electro-conductive layer of each of the cross sections of (¼)l, (¾)l and (¾)l, obtained in the above measurement of the shape of the domain. Here, T defines a thickness of the electro-conductive layer.

Next, Scanning Microscopic images of the observations square areas are obtained and then their binarized images are obtained.

Then, processing the obtained binarized images with an image processing software such as LUZEX (registered trademark: dedicated image processing analysis system, trade name: Luzex SE, manufactured by Nireco Corporation), and calculating the distribution of the distances among the centers of gravity of the domains.

Finally, from the distribution, obtaining the standard deviation E, the average value F, and calculating E/F.

In the present disclosure, an average value of respective E/F derived from nine observation square areas is used as a parameter for the Uniformity of arrangement of domains.

<Method for Controlling Domain Size, Distance Between Domains, and Uniformity of Arrangement of Domains>

It is preferable in the matrix-domain structure to form uniform domains, in order to achieve both of the recoverability from deformation and the securing of a stable discharge quantity, at a higher level.

Here, "uniform" is defined as (1) that the domains have the same size, and (2) that there is no bias in the arrangement of the domains in the matrix.

The domains that are uniformly formed suppress the concentration of a partial stress with respect to the deformation which occurs at the time of sliding, and can achieve efficient relaxation of the mechanical distortion. Furthermore, the uniformly formed domains make it easy to exhibit the effect according to the present disclosure, in combination with the effect of approximating the viscoelastic frequency characteristics of the domain and the matrix.

Regarding a size of dispersed particle (domain size) D in a case where two types of incompatible polymers are melted and kneaded, there are proposed Taylor's formula, Wu's empirical formula, and Tokita's formula shown in the following.

$$D=[C\times\sigma/\eta m\times\gamma]\times f(\eta m/\eta d) \quad \text{Taylor's formula}$$

$$\gamma\times D\times\eta m/\sigma=4(\eta d/\eta m)0.84\times\eta d/\eta m>1$$

$$\gamma\times D\times\eta m/\sigma=4(\eta d/\eta m)-0.84\times\eta d/\eta m<1 \quad \text{Wu's empirical formula}$$

$$D=f((1/\eta)^*(1/\gamma)^*(\eta d/\eta m)^*P^*\phi^*\sigma^*(1/EDK)^*(1/\tau)^*\chi_{12}) \quad \text{Tokita's formula}$$

D: domain size, C: constant, σ: interfacial tension,

ηm: viscosity of matrix, ηd: viscosity of domain,

γ: shear rate, η: viscosity of mixed system, P: probability of collision and coalescence, ϕ: volume of domain phase, EDK; energy for cutting domain phase τ: distance between critical walls, $\chi_{12}$: dimensionless parameter representing interaction between the two As shown in the above formulas, the domain size and the distance between the domains can be controlled mainly by the following four points.

(1) difference of interfacial tension between domain and matrix (2) ratio of viscosities between domain and matrix (3) shear rate at the time of kneading/amount of energy at the time of shearing (4) volume fraction of domains in electro-conductive layer The difference of interfacial tension of (1) correlates with the difference between the SP values of the first rubber constituting the matrix and the second rubber constituting the domain, and accordingly the interfacial tension can be controlled by the selection of the materials of the first and second rubbers. Specifically, the interfacial tension can be reduced by reducing the difference between the SP values. Accordingly, the difference between the SP values and the interfacial tension can be controlled at the same time, by the selection of the chemical structure of the first and second rubbers selected from diene-based rubbers, in particular, from isoprene rubber, NBR and SBR.

The ratio of the viscosities between the domain and the matrix in (2) can be adjusted by the selection of the Mooney viscosity of the raw rubber material and the blend of the type and amount of the filler. In addition, the ratio of the viscosities can be also adjusted by adding a plasticizing agent such as paraffin oil, in such an extent that the plasticizing agent does not hinder the formation of the phase-separated structure. Furthermore, the ratio of the viscosities can be adjusted by adjusting a temperature at the time when the polymers are kneaded. For information, the viscosities of the domain and the matrix can be obtained by measuring the Mooney viscosity ML(1+4) at a rubber temperature at the time when the polymers are kneaded, based on JIS K6300-1: 2013. In addition, the viscosities may be replaced with catalog values of the raw rubbers.

The shear rate at the time of kneading/the amount of energy at the time of shearing in (3) can be controlled by a rotational speed when the rubbers are kneaded and the feed rate when the rubbers are extruded. Specifically, by the increase of the rotational speed and a kneading time period when the rubbers are kneaded and the feed rate when the rubbers are extruded, the shear rate at the time of kneading/the amount of the energy at the time of shearing can be raised.

The volume fraction of the domains in the electro-conductive layer of (4) correlates with the probability of the collision and coalescence between the domain and the matrix. Specifically, by increasing the volume fraction of the domains in the electro-conductive layer, the probability of the collision and coalescence between the domains and the matrix can be raised.

Specifically, the domain size can be controlled so as to be reduced by the following technique.

- To reduce the interfacial tension between rubber compositions which become the domain and the matrix, respectively
- To reduce the difference between viscosities of the rubber compositions which become the domain and the matrix, respectively
- To increase the shear rate at the time of kneading In addition, in order to reduce the distance between the domains, the distance can be controlled by the following technique in conjunction with a technique of reducing the domain size.

- To increase energy at the time of shearing
- To increase the volume fraction of the domains
- To increase the probability of the collision and coalescence <Volume Resistivity of Domain>

The domains transport electric charges by using a tunnel current which is formed between the domains. Accordingly, it is preferable that the volume resistivity of the domain is low with respect to the volume resistivity of the matrix. Specifically, the volume resistivity is $1.0\times10^{1}$ to $1.0\times10^{4}$ Ω·cm. In addition, from the viewpoints that an electric charge easily moves and the volume resistivity is lowered which can cope with a high-speed process, electron conduction is more preferable than ion conduction. Due to the volume resistivity of the domain being controlled to $1.0\times10^{1}$ Ω·cm or higher, the domain can suppress an increase of the content of electro-conductive particles (electron conductive agent) in itself. As a result, the electro-conductive layer can suppress an excessive decrease of the elasticity of the rubber in the domain, can exhibit sufficient followability of the domain and the matrix to the deformation, and accordingly, can suppress the agglomeration of the domains with each other even when the external force has been repeatedly applied. In addition, because the electro-conductive particle can exist in a stable state in the domain, the domain suppresses the migration of the electro-conductive particle to the matrix, and makes it easy to exhibit the effect according to the present disclosure. In addition, due to the volume resistivity of the domain being controlled to $1.0\times10^{4}$ Ω·cm or lower, the domain can contain a sufficient amount of electro-conductive particles in itself. Because of this, the domain can become relatively hard with respect to the matrix, resists causing the deformation caused by the external force, and makes it easy to suppress the accumulation of the mechanical distortion. In addition, due to the volume resistivity of the domain being controlled to $1.0\times10^{4}$ Ω·cm or lower, the electro-conductive layer can secure a sufficient amount of electric charges for electric discharge, also under a high-speed process in particular. Furthermore, due to the volume resistivity being controlled in the above range, the domain shows an ohmic behavior even when the electro-conductive particle is used, which accordingly reduces voltage dependency and makes it easy to achieve uniform discharge. As a result, the electro-conductive layer makes it easy to exhibit the effects according to the present disclosure.

<Method for Measuring Volume Resistivity of Domain>

The volume resistivity of the domain can be measured by producing a slice of the electro-conductive member and using a microprobe. Examples of a unit for producing the slice include a sharp razor, a microtome and an FIB.

Because the volume resistivity needs to be measured on only the domain, when the slice is produced, a slice having a film thickness smaller than the distance between the domains, which has been measured in advance by SEM, TEM or the like needs to be prepared. Accordingly, as a unit for producing the slice, a unit such as a microtome is preferable, which can prepare a very thin sample.

As for the measurement of the volume resistivity, first, one surface of the slice is grounded, then the locations of the matrix and the domain in the slice are pinpointed by a unit which can measure the volume resistivities or hardness distributions of the matrix and the domain, such as SPM and AFM. Subsequently, a probe may be brought into contact with the domain, to measure a ground current at the time when a DC voltage of 1 V has been applied, and calculate an electric resistance from the current. At this time, a unit such as SPM or AFM is preferable which can also measure the shape of a slice, because the unit can determine the film thickness of the slice and measure the volume resistivity.

The volume resistivity as in the above description is measured by dividing the electro-conductive member into four parts in the circumferential direction and five parts in the longitudinal direction, cutting out a slice sample from each of the divided regions, obtaining the measured values in the above description, to calculate the volume resistivity from an arithmetic average of the volume resistivities in total of 20 samples.

<Volume Resistivity of Matrix>

It is preferable that the volume resistivity of the matrix is high with respect to the volume resistivity of the domains, in order that the electro-conductive member according to the present disclosure realizes more stable and continuous discharge. Specifically, the volume resistivity is $1.0\times10^{8}$ Ω·cm or higher, and more preferably is $1.0\times10^{12}$ Ω·cm or higher. When the volume resistivity is $1.0\times10^{8}$ Ω·cm or higher, the domains result in being separated from each other by a highly resistant matrix, the interface becomes capable of accumulating more electric charges therein, and the structure becomes more suitable for realizing the stable and continuous electric discharge. In addition, in order to realize such a high volume resistivity, the matrix shall not substantially contain an electro-conductive particle. As a result, the matrix exhibits the excellent elasticity of the rubber, and forms a structure advantageous for exhibiting more excellent recoverability from the deformation.

<Method for Measuring Volume Resistivity of Matrix>

The volume resistivity of the matrix may be measured by the same method as in the measurement of the volume resistivity of the above domain, except that the ground current has been measured at the time when a DC voltage of 50 V has been applied. The volume resistivity as in the above description is measured by dividing the electro-conductive member into four parts in the circumferential direction and five parts in the longitudinal direction, cutting out a slice sample from each of the divided regions, obtaining the measured values in the above description, to calculate the volume resistivity from an arithmetic average of the volume resistivities in total of 20 samples.

<Shape of Electro-Conductive Member>

The electro-conductive member having a roller shape is used in a contact state, as a charging member for charging an electrophotographic photosensitive member (photosensitive drum). In this case, it is preferable that the electro-conductive member has a shape in which an outer diameter of the central portion in the longitudinal direction is the thickest, and the outer diameter decreases along the direction toward both ends in the longitudinal direction, which is called as a crown shape, in order to make a width of the nip between the charging member extending in the longitudinal direction and the photosensitive drum more uniform. As for the amount of the crown, it is preferable that the difference between the outer diameter of the central portion in the longitudinal direction and an average value of the outer diameters of two points at the right and left positions which are 90 mm away from the central portion is 30 μm or larger and 160 μm or smaller. Due to the amount of the crown being set in this range, the electro-conductive member can make the contact state between itself and the photosensitive drum more stable. As a result, the external force tends to be easily applied uniformly over the whole region of the abutting portion between the electro-conductive member and the photosensitive drum, which thereby can suppress a partial accumulation of the mechanical distortion and an unevenness in the relaxation of the distortion.

<Hardness of Electro-Conductive Layer>

The hardness of the electro-conductive layer of the electro-conductive member is preferably 90° or lower in micro hardness (MD-1 type), and more preferably is 50° or higher and 85° or lower. Due to the micro hardness being controlled to 50° or higher, the rubber can obtain sufficient elasticity; and the electro-conductive layer resists causing deformation even when having abutted on the photosensitive drum for a long period of time, and makes it easy to suppress an unattended set streak. Due to the micro hardness being controlled to 85° or lower, the electro-conductive layer can suppress an excessive decrease of the width of the nip that abuts on the photosensitive drum, which accordingly suppresses a change of a member due to the excessive concentration of the stress in the abutting portion, and a movement of the electro-conductive particles. As a result, the electro-conductive layer suppresses a difference between the electrical characteristics, in other words, the discharge quantities of the abutting portion and the non-abutting portion, and makes it easy to suppress the unattended set streak. In addition, due to the micro hardness being controlled in the above range, it becomes easy for the electro-conductive layer to stabilize the abutment on the photosensitive drum, and the electro-conductive member can charge the photosensitive drum more uniformly. For information, the micro hardness (MD-1 type) is a hardness which is measured by pressing a pressing needle against the outer surface of the electro-conductive layer with the use of a micro rubber hardness meter. The hardness of the electro-conductive layer can be adjusted by the amount of sulfur which is contained in the material mixture for forming the electro-conductive layer, a type and amount of the vulcanization accelerator, a vulcanization temperature, a vulcanization time period, and the contents of the electro-conductive particle and the filler.

<Method for Manufacturing Electro-Conductive Member>

A method for manufacturing an electro-conductive member according to one aspect of the present disclosure will be described below.

(A) a step of preparing a carbon masterbatch (CMB) for forming the domain, which contains electro-conductive carbon black and the second rubber;

(B) a step of preparing the first rubber composition which becomes the matrix; and (C) a step of kneading the carbon masterbatch and the first rubber composition to prepare a rubber composition having the matrix-domain structure.

In the domain, electro-conductive particles such as electro-conductive carbon black are unevenly distributed. In order to obtain such a configuration, a method of producing a semi-electroconductive rubber composition by producing a masterbatch in which the electro-conductive particles are added only to the domain in advance, as in the above step (A), and then blending the obtained masterbatch with the first rubber composition which becomes the matrix is effective. In other words, the rubber composition (rubber mixture) in which the electro-conductive particles are unevenly distributed in the domain can be manufactured by preparing the CMB by blending the electro-conductive particles with the second raw rubber material, and blending the obtained CMB with the first rubber composition which becomes the matrix.

As for the method of kneading the CMB which becomes the domain and the unvulcanized rubber composition which becomes the matrix to obtain an unvulcanized rubber composition having a matrix-domain structure, in the above step (C), examples thereof include the following method.

A method of mixing each of the CMB which becomes the domain and the unvulcanized rubber composition which becomes the matrix, with the use of a closed type mixer such as a Banbury mixer or a pressurization type kneader; and then, kneading the CMB which becomes the domain, the unvulcanized rubber composition which becomes the matrix, and raw materials such as the vulcanizing agent and the vulcanization accelerator to integrate the materials, with the use of an open type mixer such as an open roll.

A method of mixing the CMB which becomes the domain with the use of a closed type mixer such as the Banbury mixer or the pressurization type kneader, and then mixing the CMB which becomes the domain and the raw material of the unvulcanized rubber composition which becomes the matrix with a closed type mixer; and then, kneading the raw materials such as the vulcanizing agent and the vulcanization accelerator with the use of an open type mixer such as an open roll to integrate the materials.

The electro-conductive layer is formed by molding the rubber composition having the matrix-domain structure on an electro-conductive support, by a well-known method such as extrusion, injection molding and compression molding. In addition, the electro-conductive layer is bonded to the electro-conductive support via an adhesive as needed, and after that, the electro-conductive layer formed on the electro-conductive support is vulcanized to become a cross-linked body of the rubber mixture.

The matrix-domain structure of the electro-conductive layer can be controlled by a mixing time period in the above closed type mixer and the open type mixer such as the open roll, the clearance between rolls of the mixer, and a molding speed in the extrusion, the injection molding, the compression molding or the like.

<Process Cartridge for Electrophotography>

Figure 6:
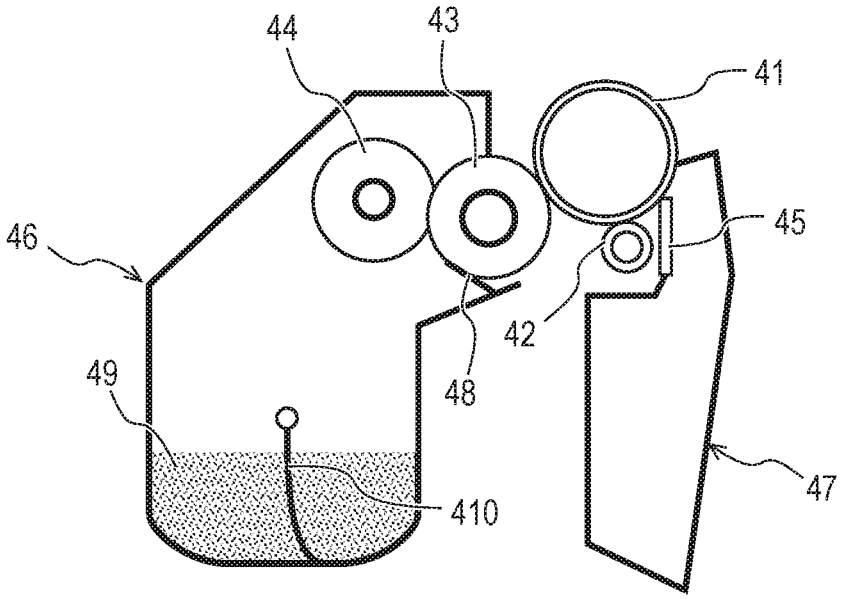
FIG. 6 illustrates a cross-sectional view of a process cartridge according to the present disclosure.

FIG. 6 illustrates a schematic cross-sectional view of a process cartridge for electrophotography, which includes the electro-conductive member according to the present disclosure as a charging roller. This process cartridge is an apparatus which integrates a developing apparatus with a charging apparatus, and is configured to be detachably attachable to a main body of an electrophotographic image forming apparatus. The developing apparatus is an apparatus which integrates at least a developing roller 43 with a toner container 46, and may include a toner supply roller 44, a toner 49, a developing blade 48 and a stirring blade 410, as needed. The charging apparatus is an apparatus which integrates at least an electrophotographic photosensitive member (photosensitive drum) 41, a cleaning blade 45, and a charging roller 42, and may include a waste toner container 47. The charging roller 42, the developing roller 43, the toner supply roller 44 and the developing blade 48 are structured so that a voltage is applied to each of themselves.

<Electrophotographic Image Forming Apparatus>

Figure 7:
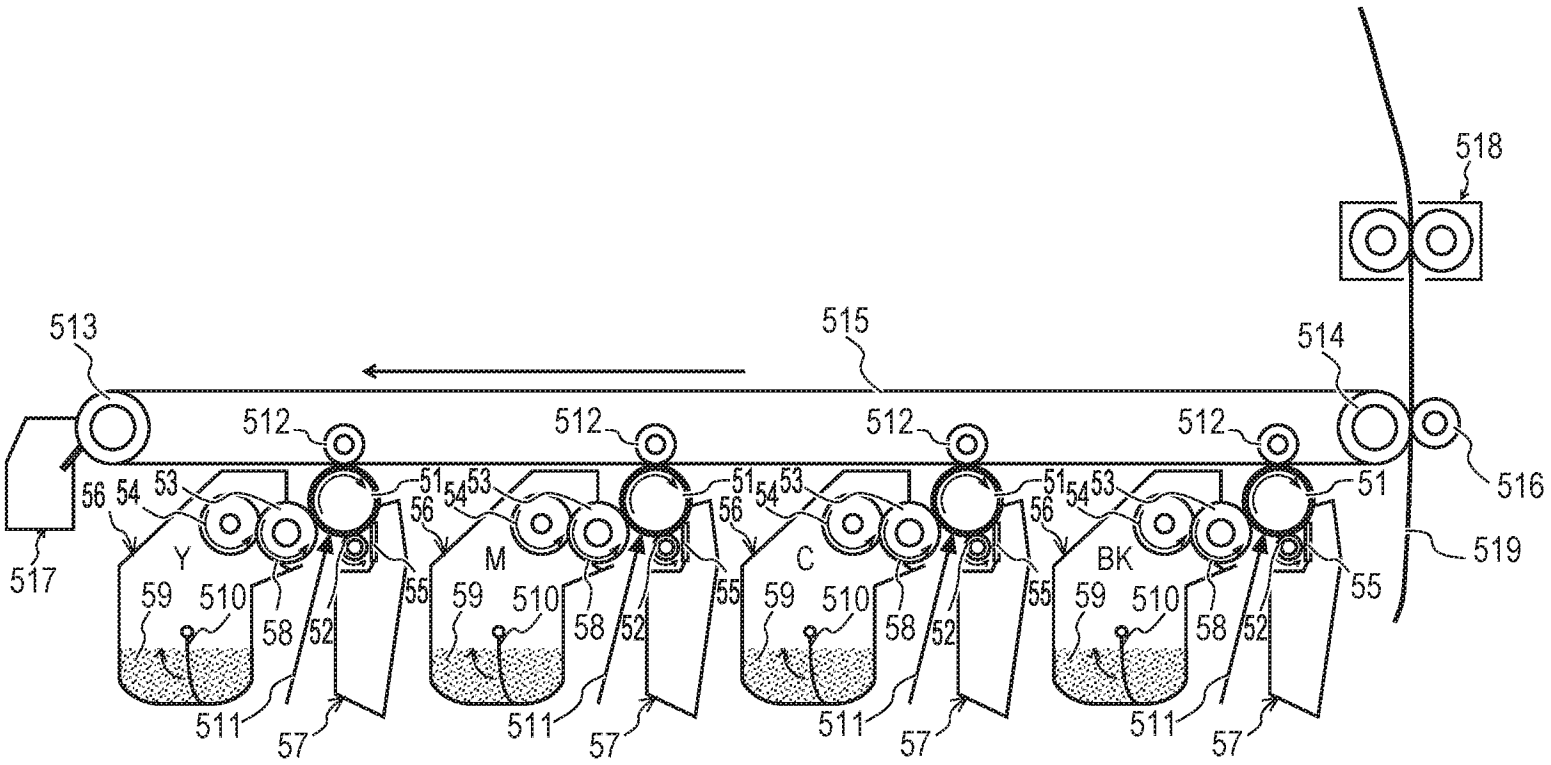
FIG. 7 illustrates a cross-sectional view of an electrophotographic image forming apparatus according to the present disclosure.

FIG. 7 illustrates a schematic configuration diagram of an electrophotographic image forming apparatus which uses the electro-conductive member according to the present disclosure as a charging roller. The electrophotographic image forming apparatus is a color electrophotographic image forming apparatus on which four process cartridges for electrophotography are detachably mounted. In each process cartridge, a toner of each color of black (BK), magenta (M), yellow (Y) and cyan (C) is used. A photosensitive drum 51 rotates in the direction of the arrow, and is uniformly charged by a charging roller 52 to which a voltage is applied from a charging bias power source; and an electrostatic latent image is formed on the surface thereof by an exposure light 511. On the other hand, a toner 59 which is stored in a toner container 56 is supplied to a toner supply roller 54 by a stirring blade 510, and is conveyed onto a developing roller 53. Then, the surface of the developing roller 53 is uniformly coated with the toner 59 by a developing blade 58 which is arranged so as to come in contact with the developing roller 53, and at the same time, an electric charge is given to the toner 59 by frictional charging. The toner 59 is conveyed by the developing roller 53 which is arranged in contact with the photosensitive drum 51, and is given to the photosensitive drum 51; and the above electrostatic latent image is developed by the toner 59 and is visualized as a toner image.

The visualized toner image on the photosensitive drum is transferred to an intermediate transfer belt 515 which is supported and driven by a tension roller 513 and an intermediate transfer belt driving roller 514, by a primary transfer roller 512 to which a voltage is applied by a primary transfer bias power source. The toner images of each color are sequentially superimposed, and a color image is formed on the intermediate transfer belt.

A transfer material 519 is fed into the apparatus by a feed roller, and is conveyed to a space between the intermediate transfer belt 515 and a secondary transfer roller 516. A voltage is applied to the secondary transfer roller 516 from the secondary transfer bias power source, and the color image on the intermediate transfer belt 515 is transferred to the transfer material 519. The transfer material 519 to which the color image has been transferred is subjected to fixing processing by a fixing device 518, and is discharged to the outside of the apparatus; and the printing operation ends.

On the other hand, the toner which has remained on the photosensitive drum without being transferred is scraped off by a cleaning blade 55, and is stored in a waste toner storage container 57; and the cleaned photosensitive drum 51 repeats the above steps. In addition, the toner which has remained on the primary transfer belt without being transferred is also scraped off by a cleaning apparatus 517.

EXAMPLE

The present disclosure will be specifically described below with reference to Examples, but the present disclosure is not limited to the structure embodied in the Examples. Note that in the following description, "%" regarding a quantitative ratio is based on mass, unless otherwise specified.

First, starting materials which are used in Examples and Comparative Examples will be described.

<NBR>

NBR (1) (trade name: JSR NBR N260S, nitrile content: 15%, SP value: 17.2 $(J/cm^3)^{0.5}$, manufactured by JSR Corporation, and abbreviated expression: N260S)

NBR (2) (trade name: JSR NBR N220S, nitrile content: 41.5%, SP value: 20.6 $(J/cm^3)^{0.5}$, manufactured by JSR Corporation, and abbreviated expression: N220S)

NBR (3) (trade name: Nipol DN302, nitrile content: 27.5%, SP value: 18.8 $(J/cm^3)^{0.5}$, manufactured by Zeon Corporation, and abbreviated expression: DN302)

NBR (4) (trade name: Nipol DN401LL, nitrile content: 18.0%, SP value: 17.4 $(J/cm^3)^{0.5}$, manufactured by Zeon Corporation, and abbreviated expression: DN401LL)

NBR (5) (trade name: Nipol N230S, nitrile content: 35%, SP value: 20.0 $(J/cm^3)^{0.5}$, manufactured by Zeon Corporation, and abbreviated expression: N230S)

NBR (6) (trade name: JSR NBR N202S, nitrile content: 40.0%, SP value: 20.4 $(J/cm^3)^{0.5}$, manufactured by JSR Corporation, and abbreviated expression: N202S)

<Isoprene Rubber>

Isoprene (1) (trade name: Nipol 2200, SP value: 16.8 $(J/cm^3)^{0.5}$, manufactured by Zeon Corporation, and abbreviated expression: IR2200)

<SBR>

SBR (1) (trade name: Asaprene 303, styrene content: 45%, SP value: 17.4 $(J/cm^3)^{0.5}$, manufactured by Asahi Kasei Corp., and abbreviated expression: A303)

SBR (2) (trade name: Tufdene 2000R, styrene content: 25%, SP value: 17.0 $(J/cm^3)^{0.5}$, manufactured by Asahi Kasei Corp., and abbreviated expression: T2000R)

SBR (3) (trade name: Tufdene 1000, styrene content: 18%, SP value: 16.8 $(J/cm^3)^{0.5}$, manufactured by Asahi Kasei Corp., and abbreviated expression: T1000)

SBR (4) (trade name: Nipol NS612, styrene content: 15%, SP value: 16.6 $(J/cm^3)^{0.5}$, manufactured by ZS Elastomers Co. Ltd., and abbreviated expression: NS612)

SBR (5) (trade name: Tufdene 4850, styrene content: 40%, SP value: 17.2 $(J/cm^3)^{0.5}$, manufactured by Asahi Kasei Corp., and abbreviated expression: T4850)

<Butadiene Rubber BR>

Butadiene rubber (1) (trade name: UBEPOL BR130B, SP value: 16.8 $(J/cm^3)^{0.5}$, manufactured by Ube Industries, Ltd., and abbreviated expression: BR130B)

<Chloroprene rubber (CR)>

Chloroprene rubber (trade name: SKYPRENE B31, SP value: 17.4 $(J/cm^3)^{0.5}$, manufactured by Tosoh Corporation, and abbreviated expression: B31)

<EPDM (Ethylene-propylene-diene ternary copolymer)>

EPDM (1) (trade name: EPT4045, SP value: 16.4 $(J/cm^3)^{0.5}$, manufactured by Mitsui Chemicals, Inc.)

EPDM (2) (trade name: Esprene P524, SP value: 15.8 $(J/cm^3)^{0.5}$, manufactured by Sumitomo Chemical Company)

<Epichlorohydrin Rubber (EO-EP-AGE Ternary Co-Compound)>

Hydrin (trade name: Epichlomer CG, SP value: 18.5 $(J/cm^3)^{0.5}$, manufactured by Osaka Soda Co., Ltd.)

<Electro-Conductive Particle>

Carbon black (1) (trade name: Toka Black #5500, manufactured by Tokai Carbon Co., Ltd., and abbreviated expression: #5500)

Carbon black (2) (trade name: Toka Black #7360SB, manufactured by Tokai Carbon Co., Ltd., and abbreviated expression: #7360SB)

<Vulcanizing Agent>

Vulcanizing agent (1) (trade name: SULFAX200S, sulfur content 99.5%, manufactured by Tsurumi Chemical Industry Co., Ltd.)

Vulcanizing agent (2) (trade name: Sanmix S-80N, sulfur content 80%, NBR masterbatch, manufactured by Sanshin Chemical Industry Co., Ltd.)

Vulcanizing agent (3) (trade name: SULFAXSB, sulfur content 50%, SBR masterbatch, manufactured by Tsurumi Chemical Industry Co., Ltd.)

Vulcanizing agent (4) (trade name: KyowaMag MF30, purity 99.7%, magnesium oxide, manufactured by Kyowa Chemical Industry Co., Ltd., and abbreviated expression: MgO)

<Vulcanization Accelerator>

Vulcanization accelerator (1) (trade name: NOCCELER DM-P, di-2-benzothiazolyl disulfide, manufactured by Ouchi Shinko Chemical Industrial Co., Ltd., and abbreviated expression: DM)

Vulcanization accelerator (2) (trade name: Sanceler TT, tetramethylthiuram disulfide, manufactured by Sanshin Chemical Industry Co., Ltd., and abbreviated expression: TT)

Vulcanization accelerator (3) (trade name: Sanceler TBZTD, tetrabenzylthiuram disulfide, manufactured by Sanshin Chemical Industry Co., Ltd., and abbreviated expression: TBZTD)

Vulcanization accelerator (4) (trade name: NOCCELER CZ-G, tetrabenzylthiuram disulfide, manufactured by Ouchi Shinko Chemical Industrial Co., Ltd., and abbreviated expression: CZ)

Vulcanization accelerator (5) (trade name: NOCCELER M-P(M), mercaptobenzothiazole, Ouchi Shinko Chemical Industrial Co., Ltd., and abbreviated expression: M)

Vulcanization accelerator (6) (trade name: NOCCELER NS-P, N-tert-butyl-2-benzothiazolyl sulfenamide, manufactured by Ouchi Shinko Chemical Industrial Co., Ltd., and abbreviated expression: NS)

Vulcanization accelerator (7) (trade name: Sanceler 22-C, 2-imidazoline-2-thiol, manufactured by Sanshin Chemical Industry Co., Ltd., and abbreviated expression: ETU)

Vulcanization accelerator (8) (trade name: NOCCELER TRA, dipentamethylenethiuram tetrasulfide, manufactured by Ouchi Shinko Chemical Industrial Co., Ltd., and abbreviated expression: TRA)

Vulcanization accelerator (9) (trade name: NOCCELER D, 1,3-diphenylguanidine, manufactured by Ouchi Shinko Chemical Industrial Co., Ltd., and abbreviated expression: DP)

Vulcanization accelerator (10) (trade name: Sanceler PZ, dithiocarbamate, manufactured by Sanshin Chemical Industry Co., Ltd., and abbreviated expression: PZ)

Example 1

(1. Manufacture of Unvulcanized Domain Composition)

[1-1. Preparation of Unvulcanized Domain Composition]

The types and amounts of materials shown in Table 1 were mixed with each other by a pressure kneader, and an unvulcanized domain composition was obtained.

TABLE 1

Raw materials for unvulcanized domain composition

| | Raw material name | Blended amount (parts by mass) |
|---|---|---|
| Raw rubber | NBR (Trade name: JSR NBR N260S manufactured by JSR Corporation) | 100 |
| Electron conductive agent | Carbon black (trade name: TokaBlack #5500 manufactured by Tokai Carbon Co., Ltd.) | 60 |
| Vulcanization accelerating aid | Zinc oxide (trade name: Zinc White manufactured by Sakai Chemical Industry Co., Ltd.) | 5 |
| Processing aid | Zinc stearate (trade name: SZ-2000 manufactured by Sakai Chemical Industry Co., Ltd.) | 2 |

[1-2. Preparation of Unvulcanized Rubber Composition]

The types and amounts of materials shown in Table 2 were mixed with each other by a pressure kneader, and an unvulcanized rubber composition was obtained.

TABLE 2

Raw materials for unvulcanized rubber composition

| | Raw material name | Blended amount (parts by mass) |
|---|---|---|
| Raw rubber | Unvulcanized domain composition | 30 |
| Raw rubber | Polyisoprene (trade name: Nipol 2200NS manufactured by Zeon Corporation) | 70 |
| Filler | Calcium carbonate (trade name: NANOX #30 manufactured by Maruo Calcium Co., Ltd.) | 40 |
| Vulcanization accelerating aid | Zinc oxide (trade name: Zinc White manufactured by Sakai Chemical Industry Co., Ltd.) | 5 |
| Processing aid | Zinc stearate (trade name: SZ-2000 manufactured by Sakai Chemical Industry Co., Ltd.) | 2 |

The types and amounts of materials shown in Table 3 were mixed with each other in an open roll, and a rubber composition for molding of an electro-conductive member was prepared.

TABLE 3

| Rubber composition for molding of electro-conductive member | | |
|---|---|---|
| | Raw material name | Blended amount (parts by mass) |
| Raw rubber | Unvulcanized rubber composition | 100 |
| Vulcanizing agent | Dispersive sulfur (trade name: SULFAX 200S, sulfur content 99.5%, manufactured by Tsurumi Chemical Industry Co., Ltd.) | 3 |
| Vulcanization accelerator (1) | Di-2-benzothiazolyl disulfide (trade name: NOCCELER DM-P manufactured by Ouchi Shinko Chemical Industrial Co., Ltd.) | 2 |
| Vulcanization accelerator (2) | Tetramethylthiuram disulfide (trade name: Sanceler TT manufactured by Sanshin Chemical Industry Co., Ltd.) | 0.5 |

<2. Molding of Electro-Conductive Member>

A round bar of free-cutting steel was prepared, which had a total length of 252 mm and an outer diameter of 6 mm, and of which the surface was subjected to electroless nickel plating. Next, Metalok U-20 (trade name, manufactured by Toyokagaku Kenkyusho Co., Ltd.) of an adhesive was applied onto the whole circumference in a range of 230 mm except for 11 mm at both ends of the above round bar, with the use of a roll coater. In the present example, the round bar onto which the above adhesive was applied was used as an electro-conductive support.

Next, a die having an inner diameter of 12.5 mm was attached to the tip of a cross head extruder which had a supply mechanism for an electro-conductive support and a discharge mechanism for an unvulcanized rubber roller, temperatures of the extruder and the cross head were adjusted at 80° C., and a conveyance speed of the electro-conductive shaft body was adjusted to 60 mm/sec. Under these conditions, an unvulcanized rubber composition was supplied from an extruder, thereby the outer circumferential portion of the electro-conductive support was coated with the unvulcanized rubber composition in the cross head, and an unvulcanized rubber roller was obtained.

Next, the above unvulcanized rubber roller was placed in a hot air vulcanizing furnace at 170° C., and the unvulcanized rubber composition was vulcanized by being heated there for 60 minutes; and a roller was obtained which had an electro-conductive layer formed on the outer circumferential portion of the electro-conductive support. After that, both ends of the electro-conductive layer were cut off by 10 mm each, and the length of the electro-conductive resin layer portion in the longitudinal direction was set at 231 mm.

Finally, the surface of the electro-conductive layer was polished with a rotating grindstone. Thereby, an electro-conductive member (1) was obtained of which diameters at positions of 90 mm apart from the central portion to both ends side were each 8.44 mm, the diameter in the central portion was 8.5 mm, and the amount of the crown was 60 μm.

The electro-conductive members (2) to (39) were produced in the same manner as the electro-conductive member (1) except that the starting materials shown in Table 4-1 and Table 4-2 were used. Table 4-1 and Table 4-2 show the parts by mass and physical properties of the starting materials which were used for the production of each of the electro-conductive members. In addition, the electro-conductive member (39) was produced in the same manner as the electro-conductive member (22), except for having used the materials shown in Table 4-1 and Table 4-2, having been extruded so as to become a straight shape (crown 0 μm), and having been subjected to polishing treatment.

TABLE 4-1

| Electro-conductive member Number | Unvulcanized rubber composition for domain: Second rubber: Type of rubber | Second rubber: Abbreviated expression | Electro-conductive particle: Abbreviated expression | Electro-conductive particle: Number of parts | Unvulcanized rubber composition for matrix: First rubber: Type of rubber | First rubber: Abbreviated expression | Filler: Abbreviated expression | Filler: Number of parts | Domain content (% by mass) |
|---|---|---|---|---|---|---|---|---|---|
| 1 | NBR | N260S | #5500 | 60 | IR | IR2200 | #30 | 40 | 30 |
| 2 | NBR | N220S | #5500 | 60 | | | #30 | 40 | 30 |
| 3 | | DN302 | #5500 | 60 | | | #30 | 40 | 30 |
| 4 | IR | IR2200 | #5500 | 70 | NBR | N260S | #30 | 30 | 20 |
| 5 | | | #5500 | 70 | | N230S | #30 | 40 | 20 |
| 6 | SBR | A303 | #7360SB | 80 | IR | IR0310KU | #30 | 40 | 30 |
| 7 | IR | IR2200 | #7360SB | 80 | SBR | T2000R | #30 | 40 | 30 |
| 8 | CR | B31 | #5500 | 60 | IR | IR2200 | #30 | 40 | 30 |
| 9 | IR | IR2200 | #5500 | 70 | CR | B31 | #30 | 40 | 25 |
| 10 | BR | BR130B | #5500 | 75 | SBR | A303 | #30 | 40 | 30 |
| 11 | SBR | A303 | #5500 | 65 | BR | BR130B | #30 | 40 | 30 |
| 12 | NBR | N260S | #7360SB | 60 | SBR | T2000R | #30 | 40 | 30 |
| 13 | | DN401LL | #7360SB | 60 | | | #30 | 40 | 30 |
| 14 | | DN302 | #7360SB | 60 | | | #30 | 40 | 30 |
| 15 | | N230S | #7360SB | 60 | | T1000 | #30 | 40 | 25 |
| 16 | | N220S | #7360SB | 60 | | NS612 | #30 | 30 | 25 |
| 17 | | N202S | #7360SB | 60 | | T4850 | #30 | 30 | 25 |
| 18 | | N230S | #7360SB | 60 | | A303 | #30 | 30 | 25 |
| 19 | SBR | T2000R | #5500 | 65 | NBR | N2605 | #30 | 30 | 25 |
| 20 | | T1000 | #5500 | 65 | | DN401LL | #30 | 50 | 25 |
| 21 | | T2000R | #5500 | 65 | | | #30 | 50 | 25 |
| 22 | | | #5500 | 65 | | N230S | #30 | 40 | 20 |
| 23 | | T4850 | #5500 | 65 | | N202S | #30 | 40 | 20 |
| 24 | | NS612 | #5500 | 65 | | N220S | #30 | 40 | 20 |
| 25 | | A303 | #5500 | 65 | | N230S | #30 | 40 | 25 |
| 26 | NBR | DN401LL | #7360SB | 60 | SBR | T2000R | #30 | 40 | 30 |

TABLE 4-1-continued

| Electro-conductive member Number | Unvulcanized rubber composition for domain: Second rubber: Type of rubber | Second rubber: Abbreviated expression | Electro-conductive particle: Abbreviated expression | Electro-conductive particle: Number of parts | Unvulcanized rubber composition for matrix: First rubber: Type of rubber | First rubber: Abbreviated expression | Filler: Abbreviated expression | Filler: Number of parts | Domain content (% by mass) |
|---|---|---|---|---|---|---|---|---|---|
| 27 | | | #7360SB | 60 | | | #30 | 40 | 30 |
| 28 | | | #7360SB | 60 | | | #30 | 40 | 30 |
| 29 | | | #7360SB | 60 | | | #30 | 40 | 30 |
| 30 | SBR | T2000R | #5500 | 65 | NBR | N230S | #30 | 40 | 20 |
| 31 | | | #5500 | 65 | | | #30 | 40 | 20 |
| 32 | | | #5500 | 65 | | | #30 | 40 | 20 |
| 33 | | | #5500 | 65 | | | #30 | 40 | 20 |
| 34 | | | #5500 | 65 | | | #30 | 40 | 12 |
| 35 | | | #5500 | 65 | | | #30 | 40 | 15 |
| 36 | | | #5500 | 65 | | | #30 | 40 | 40 |
| 37 | | | #5500 | 65 | | | #30 | 40 | 42 |
| 38 | | NS612 | #5500 | 65 | | N220S | #30 | 80 | 20 |
| 39 | SBR | T2000R | #5500 | 65 | NBR | N230S | #30 | 40 | 20 |

TABLE 4-2

| Electro-conductive member Number | Rubber composition for forming electro-conductive member: Vulcanizing agent (1): Name of product | Vulcanizing agent (1): Number of parts | Vulcanizing agent (2): Name of product | Vulcanizing agent (2): Number of parts | Vulcanization accelerator (1): Abbreviated expression | Vulcanization accelerator (1): Number of parts | Vulcanization accelerator (2): Abbreviated expression | Vulcanization accelerator (2): Number of parts | Shape: Crown (μm) |
|---|---|---|---|---|---|---|---|---|---|
| 1 | SULFAX | 3 | — | — | DM | 2 | TT | 0.5 | 60 |
| 2 | 200S | 3 | — | — | | | | | |
| 3 | | 3 | — | — | | | | | |
| 4 | | 3 | — | — | | | | | |
| 5 | | 3 | — | — | | | | | |
| 6 | | 3 | — | — | | | | | |
| 7 | | 3 | — | — | | | | | |
| 8 | SULFAX | 1 | MgO | 4 | ETU | 1 | TRA | 0.7 | 60 |
| 9 | 200S | 1 | | | | | | | |
| 10 | SULFAX | 3 | — | — | DM | 2 | TT | 0.5 | |
| 11 | 200S | 3 | — | — | | | | | |
| 12 | SULFAX | 4.2 | S-80 | 1.1 | DM | 2 | TBZTD | 0.5 | 60 |
| 13 | SB | 4.2 | NBR | 1.1 | | | | | |
| 14 | | 4.2 | | 1.1 | | | | | |
| 15 | | 4.5 | | 0.9 | | | | | |
| 16 | | 4.5 | | 0.9 | | | | | |
| 17 | | 4.5 | | 0.9 | | | | | |
| 18 | | 4.5 | | 0.9 | | | | | |
| 19 | S-80 | 2.8 | SULFAX | 1.5 | DM | 2 | TBZTD | 0.5 | 60 |
| 20 | NBR | 2.8 | SB | 1.5 | | | | | |
| 21 | | 2.8 | | 1.5 | | | | | |
| 22 | | 3 | | 1.2 | | | | | |
| 23 | | 3 | | 1.2 | | | | | |
| 24 | | 3 | | 1.2 | | | | | |
| 25 | | 2.8 | | 1.5 | | | | | |
| 26 | SULFAX | 4.2 | S-80 | 1.1 | NS | 1.5 | TBZTD | 0.5 | 60 |
| 27 | SB | 4.2 | NBR | 1.1 | CZ | | | | |
| 28 | | 4.2 | | 1.1 | M | | | | |
| 29 | | 4.2 | | 1.1 | DP | | | | |
| 30 | S-80 | 3 | SULFAX | 1.2 | NS | | | | |
| 31 | NBR | 3 | SB | 1.2 | CZ | | | | |
| 32 | | 3 | | 1.2 | M | | | | |
| 33 | | 3 | | 1.2 | DP | | | | |
| 34 | | 3.3 | | 0.7 | CZ | | | | |
| 35 | | 3.2 | | 0.9 | | | | | |
| 36 | | 2.3 | | 2.4 | | | | | |
| 37 | | 2.2 | | 2.5 | | | | | |
| 38 | | 3 | | 1.2 | DM | 2 | TBZTD | 0.5 | |
| 39 | S-80 | 3 | SULFAX | 1.2 | DM | 2 | TBZTD | 0.5 | 0 |
| | NBR | | SB | | | | | | |

<3. Characteristics Evaluation>

Subsequently, the electro-conductive members according to Examples and Comparative Examples were subjected to the following evaluations.

[3-1] Identification of Chemical Structure of Rubber/Confirmation of Existence of Sulfur The chemical structure of domains and matrices can be specified by a combination of conventional analytical methods such as solid-state NMR and pyrolysis gas chromatography (hereinafter also referred to as "Py-GC") with TEM-EELS (electron energy loss spectroscopy).

First, two types of rubbers contained in the domain and the matrix which were contained in the electro-conductive layer were identified with the use of the solid-state NMR. After that, an ultra-thin layer slice of 100 nm or thinner was prepared from an electro-conductive layer, for TEM analysis, while a cryomicrotome (trade name "Leica EMFCS", manufactured by Leica Microsystems K.K.) was used as a cutting apparatus and a cutting temperature was set at −100° C. After that, the obtained ultra-thin layer slice of the electro-conductive layer was dyed with osmium oxide or dyed with ruthenium oxide, and the resultant slice was analyzed by TEM-EELS (trade name: H-7100FA, manufactured by Hitachi High-Technologies Corporation). At this time, images were taken so that contrast differences were each formed among the domain, the matrix and the electro-conductive particle.

Dyeing with the ruthenium oxide selectively dyes an amorphous portion of a lamella, and accordingly rubber having a benzene ring such as a styrene skeleton is dyed, and is observed to be dark in an electronic image. In addition, dying with the osmium oxide dyes the rubber by reacting with double bonds in the rubber, and accordingly rubber having many double bonds, such as isoprene, is dyed, and is observed to be dark in an electronic image. From the contrast difference between the domain and the matrix at this time, and from an elemental mapping analysis of sulfur, nitrogen, chlorine and the like, it is possible to specify the chemical structure of each of the cross-linked products in the rubbers which are contained in the domain and the matrix, and to determine a sulfur content therein.

For example, when the ultra-thin layer slice of the electro-conductive layer of which the presence of NBR and SBR was confirmed in the electro-conductive layer by the solid-state NMR was dyed with ruthenium oxide, and the resultant slice was observed by the TEM-EELS, the matrix-domain structure was confirmed. In addition, the rubber of the matrix was observed to be darker than the rubber which constituted the domain containing the electro-conductive particle, in an electronic image. In addition, at the same time, an elemental mapping analysis was performed; and among the detected elements, only seven elements of C, O, N, S, Cl, Mg, and a metal of a metal oxide added as a filler (for example, Ca derived from calcium carbonate) were selected, and the images were captured. At this time, it was confirmed that N derived from acrylonitrile was detected only in the domain region. Accordingly, it was specified that the rubber constituting the domain was NBR, and the rubber constituting the matrix was SBR. Furthermore, it was confirmed that S was detected on the whole surfaces of the domain and the matrix. Accordingly, it was confirmed that sulfur was contained in the electro-conductive layer.

Furthermore, the ultra-thin layer slice of the electro-conductive layer in which NBR and isoprene were confirmed to exist in the electro-conductive layer by the solid-state NMR or the Py-GC was dyed with osmium oxide, and the resultant slice was observed by TEM-EELS. At this time, the rubber of the matrix was observed to be darker than the rubber which constituted the domain containing the electro-conductive particle, in an electronic image. In addition, at the same time, the elemental mapping analysis was performed, and the image was captured. At this time, it was confirmed that N derived from acrylonitrile was detected only in the domain region. Accordingly, it was specified that the rubber constituting the domain was NBR, and the rubber constituting the matrix was isoprene. Furthermore, it was confirmed that S was detected on the whole surfaces of the domain and the matrix. Accordingly, it was confirmed that sulfur was contained in the electro-conductive layer. The Examples and the Comparative Examples were evaluated as in the example shown above. The results are shown in Table 5-1, Table 5-2 and Table 8.

3-1-1. Solid-State NMR Measurement Method

The electro-conductive layer was batched off; and then the resultant layer was frost-shattered, was packed in a sample tube for solid-state NMR, of which the outer diameter was 3.2 mm, and was analyzed by an NMR apparatus (apparatus name: NMR spectrometer ECX 500 II, manufactured by JOEL RESONANCE Inc). A $^{13}$C-NMR spectrum was measured under the following conditions, and thereby the chemical structure of the rubber was identified which was contained in the electro-conductive layer.

Measurement Condition

Observed nucleus: $^{13}$C;

Waiting time period: 5 seconds;

MAS speed: 15 kHz; and

Number of integration: 256 times.

3-1-2. Py-GC Measurement Method

As for the Py-GC, a pyrolysis apparatus (apparatus name: PY-2020, manufactured by Frontier Laboratories Ltd.) was directly connected to an inlet of a gas chromatograph (apparatus name: 6890A, manufactured by Agilent Technologies, Inc.), and thereby the measurement was performed.

The electro-conductive layer was batched off; then approximately 300 μg of the sample was weighed in a platinum sample cup, and was placed on a pyrolysis apparatus; and the sample cup was dropped freely into a pyrolysis furnace which was kept at 550° C. A pyrolysis product which was generated at that time was separated by a separation column, the resultant product was subjected to detection by a flame ionization detector, and a pyrogram was obtained. Furthermore, the electro-conductive layer was measured under the same conditions; the pyrolysis product was subjected to detection by an atomic emission detector, and pyrograms of carbon and sulfur were obtained; peaks were identified with the use of mass spectrometry; and thereby the chemical structure of the rubber was identified and the presence or absence of the sulfur cross-link was determined. The peaks were identified by use of the mass spectrometer. The measurement conditions are as follows.

Measurement Condition

Inlet temperature: 300° C.;

Detector temperature: 320° C.;

Carrier gas: He (split ratio 50:1); and

GC oven temperature: 50° C. (2 min)→10° C./min→320° C. (10 min).

3-1-3. TEM-EELS

Measurement Condition

Acceleration voltage: 100 kV;

Observation magnification: 10000 times; and

Beam diameter: 2 nm.

[3-2] Confirmation of Matrix-Domain Structure

In order to confirm whether a matrix-domain structure can be suitably formed, the following confirmation was performed. An ultra-thin slice of the electro-conductive layer produced in the TEM-EELS measurement was photographed at 1,000 times with the use of a scanning type electron microscope (SEM) (trade name: S-4800, manufactured by Hitachi High-Technologies Corporation), and a cross-sectional image was obtained.

In the matrix-domain structure, in this cross-sectional image, as illustrated in FIG. 2, a plurality of domain components are dispersed in the matrix, and on the other hand, the matrix is in a state of communicating in the image.

Five regions in the longitudinal direction of the electro-conductive member 1 (length in longitudinal direction: 230 mm) were each divided into four equal parts, and the slices were produced from 20 points in total of arbitrary one point from each region, and were subjected to the above measurement. When the matrix-domain structure could be confirmed, the slice was evaluated as "○", and when the structure could not be confirmed, the slice was evaluated as "x". Table 5-1, Table 5-2 and Table 8 show evaluation results in Examples and Comparative Examples of the present disclosure.

[3-3] Measurement of Volume Fraction of Domain in Electro-Conductive Layer

The volume fraction of the domain was determined by the afore-mentioned method. The results are shown in Table 5-1, Table 5-2 and Table 8.

[3-4] Calculation of SP value

The SP values of the first rubber and the second rubber are defined by a value that has been calculated by a calibration curve method that uses a material of which the SP value is known.

For example, the SP values of NBR and SBR do not depend on the molecular weight, and are determined by content ratios of the monomer units which are derived from acrylonitrile and derived from styrene, respectively. Accordingly, the SP values can be calculated from calibration curves that are obtained from materials of which the content ratio and the SP value are known, respectively, based on an analysis of the content ratios of the monomer units which are derived from acrylonitrile and derived from styrene, with the use of an analytical method such as Py-GC. In addition, the SP value of the isoprene rubber is determined by structures of 1,2-polyisoprene, 1,3-polyisoprene, 3,4-polyisoprene, and cis-1,4-polyisoprene, trans-1,4-polyisoprene and the like, and by a copolymerization ratio between the polyisoprenes. Accordingly, the SP value can be calculated from a material of which the SP value is known, based on an analysis of the content ratios between structural units of the isomers by Py-GC or the like, similarly to those of SBR and NBR.

A specific method will be described below. First, the electro-conductive layer is used as a measurement sample, and is analyzed with the use of the Py-GC method under the same conditions as in [3-1]; and an abundance ratio of the following chemical structure in the electro-conductive layer is analyzed:

Acrylonitrile, butadiene, styrene, 1,2-polyisoprene, 1,3-polyisoprene and 3,4-polyisoprene; and cis-1,4-polyisoprene and trans-1,4-polyisoprene.

The styrene content in SBR and the nitrile content in NBR can be calculated from the above results, the identification results of the domain and the matrix, and the volume fraction of the domains, which have been measured in [3-1] and [3-3] described above, respectively. Furthermore, a copolymerization ratio of isoprene having a different structure can be analyzed.

When the Py-GC method is used, an absolute calibration curve method can be used as a quantitative method, which previously determines the relationship between the amount of the pyrolysis sample and the amount (area) of the key peak that has been generated, for each rubber, and quantifies the amount of the pyrolysis sample from an area of the key peak of the analysis sample. In addition, the amount of the pyrolysis sample can be quantified with the use of a relative area method which uses a relationship between area intensity ratios of key peaks of a pyrolysis sample as a calibration curve, with the use of a sample of which the nitrile content and the styrene content are known.

For example, an analysis of a sample will be described as an example, in which peaks derived from organic substances in the electro-conductive layer have been identified to be acrylonitrile that is 18.0% by mass, styrene that is 8.0% by mass, and butadiene that is 74.0% by mass, by solid-state NMR or Py-GC. After the above analysis, it is identified by TEM-EELS that the second rubber contained in the domain is SBR and the first rubber contained in the matrix is NBR, as described in [3-1]. Furthermore, as described in [3-3], the volume ratio of the domain is identified to be 30%, with the use of FIB-SEM. Because the specific gravity of SBR is 0.94 $g/cm^3$ and the specific gravity of NBR is 1.0 $g/cm^3$, when the specific gravities are converted to masses, the mass ratios of SBR and NBR in the electro-conductive layer become 28.7% and 71.3%. Accordingly, it is calculated that the styrene content of the SBR is 27.9% which is contained in the domain, and that the nitrile content of the NBR is 25.2% which is contained in the matrix.

Figure 4:
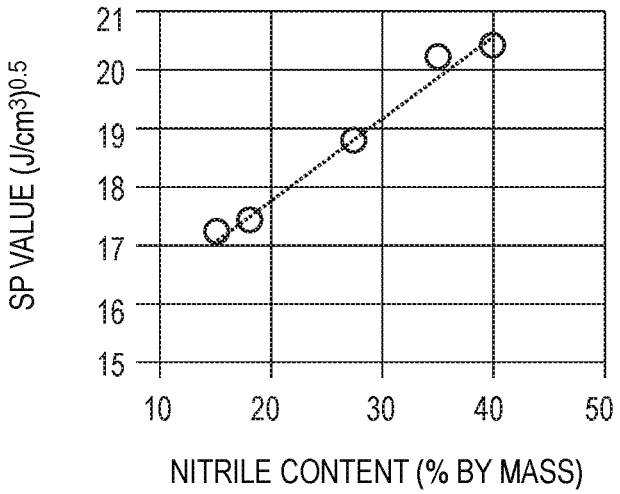
FIG. 4 illustrates a diagram of a calibration curve which has been obtained from a correlation between a percentage by mass of acrylonitrile and an SP value in NBR according to the present disclosure.
Figure 5:
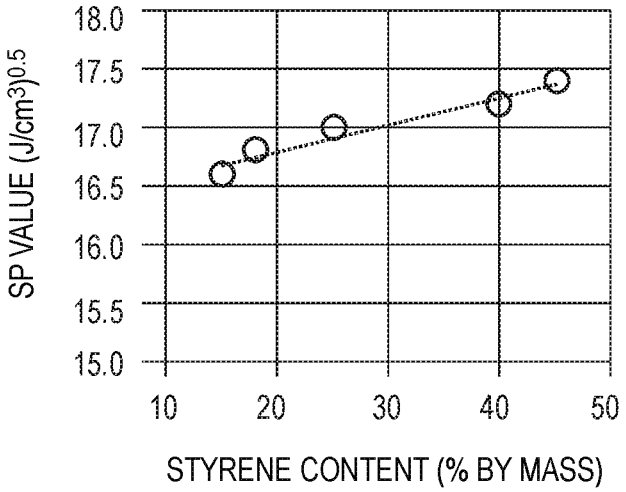
FIG. 5 illustrates a diagram of a calibration curve which has been obtained from a correlation between a percentage by mass of styrene and an SP value in SBR according to the present disclosure.

After that, a calibration curve is drawn which contains at least three plots, based on a material of which the relationship between the nitrile content and the SP value is known, as illustrated in FIG. 4, and thereby the SP value of the NBR can be calculated which is contained in the above matrix. Specifically, when the content is 25.2%, the SP value is 18.8 $(J/cm^3)^{0.5}$. Similarly, a calibration curve is drawn which contains at least three plots, based on a material of which the relationship between the styrene content and the SP value is known, as illustrated in FIG. 5, and thereby the SP value of the SBR can be calculated which is contained in the above domain. Specifically, when the content is 27.9%, the SP value is 17.0 $(J/cm^3)^{0.5}$. The difference of the SP values of the first rubber and the second rubber of Examples and Comparative Examples calculated by the afore-mentioned method, are shown in Table 5-1, Table 5-2 and Table 8.

[3-5] Measurement of Tan δ of Domain and Matrix

The loss tangent (tan δ) was measured as follows. First, by using rubber compositions which are same as the unvulcanized rubber composition for the domain and the unvulcanized rubber composition for the matrix, vulcanized rubber sheets were prepared. Then the obtained vulcanized rubber sheets were analyzed with a dynamic viscoelasticity measurement apparatus (trade name: EPLEXOR-500N, manufactured by GABO) to obtain tan δ1 and tan δ2.

As for a measurement sample,

Items necessary for preparing the rubber sheet to be used for measuring the tan δ are as follows.

Chemical structure of rubber in each of domain and matrix

Type and blended amount of vulcanizing agent

Type and blended amount of vulcanization accelerator

Type and blended amount of filler

Blended amount of electro-conductive particle

<Determination of Whether Filler, Vulcanizing Agent and Electro-Conductive Particle are Contained in Domain or Matrix, or Further in Both Matrix and Domain>

Specifically, the determination is performed in the following way.

The type of the rubber, and the type and the blended amount of the vulcanizing agent can be determined by the analysis of the blend of the rubber composition in each of the domain and the matrix, from the analysis results of the rollers in [3-1] to [3-4] described above. In addition, the type and the blended amount of the vulcanization accelerator can be determined by a well-known analytical method such as a sodium sulfide method, a cyanamide method, a hydrogen iodide reduction method, a sodium sulfite method and an amine method, in addition to the analysis of the vulcanization accelerator described in [3-6] which will be described later.

Furthermore, the type and the blended amount of the filler such as a metal oxide can be determined by the elemental analysis of [3-1]. At this time, by the element mapping analysis, it can be determined whether the vulcanizing agent and the filler are contained in either of the domain or the matrix, and further, in both of the matrix and the domain.

In addition, the blended amount of the electro-conductive particle that is contained in the electro-conductive layer can be analyzed by a thermogravimetric analysis (DTA-TG) which is a well-known analytical method. The analysis conditions are shown in the following.

[DTA-TG Analysis]

An appropriate amount was cut out from the electro-conductive layer with the use of a manipulator. After that, the content of the electro-conductive particle was measured with the use of thermogravimetric analysis (DTA-TG), under the following conditions. A substance that has caused the weight reduction by the heat treatment under the nitrogen atmosphere at this time corresponds to a substance derived from the rubber of the electro-conductive layer. In addition, a substance that has caused the weight reduction by the heat treatment under the oxygen atmosphere corresponds to a substance derived from the electro-conductive particle. From the relationship between the quantity ratios, the content of the electro-conductive particle was determined which was contained in a surface layer of the present disclosure.

[Measurement Condition]

Measuring equipment: Thermo plus TG8120 (trade name; manufactured by Rigaku Corporation)

Conditions of temperature rise/temperature fall: 25° C.→800° C.→200° C. (under nitrogen atmosphere) →800° C. (under oxygen atmosphere)

Conditions of temperature rise/temperature fall: 10° C./min

Sample holder for measurement; alumina pan

The blended amount of the electro-conductive particle contained in the domain can be determined from the combination of the DTA-TG analysis and the analysis result of [3-3] which have been described above.

In addition, the primary particle size and the agglomerate size (secondary particle size) of the electro-conductive particles can be analyzed by the observation of the inside of the domain at an observation magnification of 50000 to 200000, at the time of the TEM-EELS measurement in the above [3-1].

In addition, the material of the electro-conductive particle can be determined by the measurement of the DBP absorption of the electro-conductive particle, according to a method in conformity with JIS-Z8901. A sample for measurement of the DBP absorption was prepared by cutting out an appropriate amount from the electro-conductive layer with the use of a manipulator, then decomposing a polymer in the matrix layer under baking conditions of 500° C. for 24 hours, then cleaning the residue, and batching off the electro-conductive particles.

As described above, the electro-conductive layer was analyzed, and thereby the blend of the unvulcanized rubber composition for the domain and the unvulcanized rubber composition for the matrix was determined. The rubber sheet was obtained by adding the vulcanizing agent and the vulcanization accelerator which were analyzed in the above analysis and of which the amounts blended were clarified in the analysis, to this raw rubber material, and vulcanizing the resultant rubber material. Specifically, the rubber sheet having a thickness of 2 mm was obtained by placing each of the unvulcanized rubber composition for the domain and the unvulcanized rubber composition for the matrix to which the vulcanizing agent and the vulcanization accelerator were added, in a mold having a thickness of 2 mm, and cross-linking the resultant composition at 10 MPa and 170° C. for 60 minutes. The tan δ was measured with the use of this rubber sheet and under the following conditions. Table 5-1, Table 5-2 and Table 8 show evaluation results in Examples and Comparative Examples of the present disclosure. In addition, in order to evaluate frequency characteristics of the viscoelasticity (tan δ), the measurement frequency was evaluated at two levels of 0.1 Hz (low frequency) and 80 Hz (high frequency).

[Measurement Condition]

Measurement mode: tensile test mode

Measurement frequency: 0.1 Hz and 80 Hz

Measurement temperature: 23° C.

Measurement humidity: 50% RH

Transducer: 25 N

Dynamic distortion: 0.5%

Static distortion: 1.0%

Shape of measurement sample: width of 5.0 mm×length of 20 mm×thickness of 2.0 mm

[3-6] Method for Identifying Vulcanization Accelerator

The vulcanization accelerator was identified by an analysis with the use of headspace GC-MS (trade name: TRACEGCULTRA, manufactured by Thermo Fisher Scientific K.K.). The vulcanization accelerator was identified by using a standard vulcanized SBR rubber in which the structure of the vulcanization accelerator was known, as a sample for the analysis of the vulcanization accelerator, and comparing the spectra of the obtained chromatograms. The measurement conditions are as follows. Table 6 and Table 8 show evaluation results in Examples and Comparative Examples of the present disclosure.

Measurement Conditions

Sample mass: 100 mg;

Temperature of thermal extraction: 130° C. (kept for 10 minutes);

Column temperature: 40° C. (kept for 3 minutes) to 300° C.;

Rate of column temperature rise: 10° C./min;

Flow rate of carrier gas: 11 ml/min;

Split ratio: 1/100; and

Extracting gas: He.

[3-7] Measurement of Volume Resistivity of Domain

The volume resistivity of the domain was measured with the use of a scanning probe microscope (SPM) (trade name: Q-Scope250, manufactured by Quesant Instrument Corporation), in a contact mode.

First, an ultra-thin slice having a thickness of approximately 2 μm was cut out from the electro-conductive layer of the electro-conductive member, at a cutting temperature of −100° C., with the use of a microtome (trade name: Leica EMFCS, manufactured by Leica Microsystems K.K.). Next, the ultra-thin slice was placed on a metal plate, portions that came in direct contact with the metal plate were selected, and among the portions, a portion corresponding to a domain was brought into contact with a SPM cantilever; and then a voltage of 1 V was applied to the cantilever, and a current value was measured.

The surface shape of the measurement slice was observed with the SPM, and a thickness of the measurement portion was calculated from the obtained height profile. Furthermore, an area of a concave portion of a contact portion with which the cantilever came in contact was calculated from the observation result of the surface shape. The volume resistivity was calculated from the thickness and the area of the concave portion, and was defined as the volume resistivity of the domain. Five regions in the longitudinal direction of the electro-conductive member A1 (length in longitudinal direction: 230 mm) were each divided into four equal parts, and the slices were produced from 20 points in total of arbitrary one point from each region, and were subjected to the above measurement. The average value was defined as the volume resistivity of the domain. Table 6 and Table 8 show evaluation results in Examples and Comparative Examples of the present disclosure.

[3-8] Method for Measuring Domain Size

The size of the domain was obtained by subjecting an observation image which was obtained by the observation of an image obtained by a scanning electron microscope (SEM), to image processing.

As a measurement sample, a section slice was used which was obtained in the above measurement of the volume resistivity of the matrix. The section slice was set on a sample stage made from a metal so that the cross section could be observed. The cross section was photographed with the use of a scanning electron microscope (SEM) (trade name: S-4800, manufactured by Hitachi High-Technologies Corporation), under conditions of an acceleration voltage: 5 kV, photographing magnification: 1,000 times, and captured image: secondary electron image; and a surface image was obtained.

Next, the surface image was subjected to image processing (binarization) so that the matrix became white and the domain became black, with the use of image processing software Image-pro plus (product name, manufactured by Media Cybernetics Inc.), circle-equivalent diameters of arbitrary 50 pieces of the domains in the observed image were measured with a count function, and the arithmetic average value was calculated. Then, the electro-conductive member A1 was divided into five equal parts in the longitudinal direction and four equal parts in the circumferential direction, and the 20 regions were subjected to the above measurement, and an arithmetic average of the results was defined as the domain size. The evaluation results in Examples and Comparative Examples are shown in Table 6 and Table 8.

[3-9] Method for Measuring Distance Between Domains

The distance between the domains was obtained by subjecting the observation image which was obtained by the observation of an image obtained by a scanning electron microscope (SEM), to image processing.

More specifically, the distance between the domains was calculated in the same manner as in the above method for measuring the domain size, except that the domain size was measured at a photographing magnification of 5,000 times, and a function of counting the distance between the wall surfaces of the domain was used in the image processing method. Then, the electro-conductive member A1 was divided into five equal parts in the longitudinal direction and four equal parts in the circumferential direction, and the 20 regions were subjected to the above measurement, and an arithmetic average of the results was defined as the distance between the domains. Table 6 and Table 8 show evaluation results in Examples and Comparative Examples of the present disclosure, respectively.

[3-10] Evaluation of Uniformity of Domains

The uniformity of the arrangement of the domains was evaluated in the following way. The uniformity was evaluated by binarizing the captured image of the slice at each of cross sections of (¼)l, (2/4)l and (¾)l, in the above measurement of the shape of the domain, and analyzing the binarized image. The distribution of the distances between the centers of gravity was calculated by applying image processing software (trade name: dedicated image processing analysis system Luzex SE, manufactured by Nireco Corporation) to the binarized image. The standard deviation E and the average value F of the distribution were calculated by statistical processing, and E/F was calculated. The above measurement was performed in each region of 15 μm square at nine portions in total of arbitrary three portions in thickness regions between the outer surface and a depth of 0.1 T to 0.9 T, in each of the three slices, when the thickness of the electro-conductive layer was represented by T, and an average value of the values in nine portions was calculated. Table 6 and Table 8 show evaluation results in Examples and Comparative Examples of the present disclosure, respectively.

[3-11] Method for Measuring Volume Resistivity of Matrix

The volume resistivity of the matrix was measured in the same manner as in the measurement of the volume resistivity of the above domain, except that the measurement portion was set at a portion corresponding to the matrix, a voltage of 50 V was applied to the cantilever, and the current value was measured. Table 6 and Table 8 show evaluation results in Examples and Comparative Examples of the present disclosure, respectively.

[3-12] MD-1 Hardness of Electro-Conductive Layer

The MD-1 hardness of the electro-conductive layer was measured with the use of an Asker Durometer MD-1 type A (trade name, manufactured by Kobunshi Keiki Co., Ltd.). Specifically, the hardness was measured by setting the durometer that was set in a peak hold mode of 10 N, on an electro-conductive member which was left for 12 hours or longer in an environment of normal temperature and normal humidity (temperature of 23° C. and relative humidity of 55%), and the value was read. The same measurement was performed on three portions of both ends in positions 30 to 40 mm apart from the rubber ends in the axial direction of the vulcanized rubber roller and the central portion, and three portions in the circumferential direction, respectively, consequently nine portions in total, and an average value of the obtained measurement values was defined as the MD-1 hardness of the vulcanized rubber layer. Table 6 and Table 8 show evaluation results in Examples and Comparative Examples of the present disclosure, respectively.

(4. Image Evaluation)

[4-1] Image Evaluation of Unattended Set Streak

The electro-conductive member 1 was left in an environment of 23° C. and 50% RH for 48 hours, for the purpose of being conditioned to the measurement environment. Next, an electrophotographic type of laser printer (trade name: Laserjet M608dn, manufactured by HP Inc.) was prepared, as an electrophotographic image forming apparatus. Then, a process cartridge was prepared which could be mounted on the present electrophotographic image forming apparatus, and the electro-conductive member 1 was incorporated as a charging member in the process cartridge. Note that the photosensitive drum incorporated in the process cartridge together with the charging member 1 is an organic photosensitive member which has an organic photosensitive layer with a layer thickness of 23.0 μm formed on the support. The organic photosensitive layer is a multilayer type photosensitive layer that is a laminate formed of a charge generation layer and a charge transport layer containing a polyarylate (binder resin) from the support side, and the charge transport layer becomes a surface layer of the photosensitive member. In addition, the laser printer was altered so that an abutting pressure between the photosensitive drum and the electro-conductive member 1 became 500 gf (4.9 N), by adjusting a length of a spring of a bearing component which supports the electro-conductive member.

In order to evaluate the image in a high-speed process, the laser printer was altered so that the number of output sheets per unit time became 75 sheets/minute on A4 size paper, which was more than the original number of output sheets. At this time, an output speed of the recording medium was set at 370 mm/sec, and the image resolution was set at 1,200 dpi. In addition, the laser printer was left in an environment of 23° C. and 50% RH for 48 hours. After that, in the same environment, 20000 sheets of images were continuously output. When images are formed in a continuous mode in such a high-speed process, the evaluation condition is stricter, because an external force such as a shear force which is applied to the electro-conductive member increases, and at the same time, it becomes difficult for the electro-conductive member to follow the deformation recovery against the deformation which was caused by the external force.

The output electrophotographic image was such that characters of the letter "E" of the alphabet having a size of 4 points were formed on A4 size paper to reach a printing rate of 1.0%. After that, the laser printer was left for 12 hours in the state of having been stopped and in the same environment, then the transfer member was replaced with a new one, and 20 sheets of halftone images were output. Thus, an unattended set image was evaluated.

When a difference of the change of the member and the movement of the electro-conductive particle occurs between the abutting portion and the non-abutting portion, by the reason of the unevenness in the relaxation of the distortion, a difference of the electric characteristics, in other words, a difference of the discharge quantity occurs between the abutting portion and the non-abutting portion, and the electric discharge becomes ununiform. As a result, in an image particularly such as the halftone image, which tends to be easily affected by the unevenness of the discharge, an image of a streak-like white patch easily becomes apparent. This image of a streak-like white patch is referred to as the unattended set image. For information, the halftone image is an image in which lines having a width of 1 dot are drawn in a direction perpendicular to the rotation direction of an electrophotographic photosensitive member at 2 dots interval.

In the output halftone image, the unattended set image was evaluated, based on the following criteria. Table 6 and Table 8 show the evaluation results in the Examples and Comparative Examples, respectively.

Rank A: any of streak and the like originating in unattended setting does not appear.

Rank B: streak or the like originating in the unattended setting occurred very slightly, but the image defects completely disappeared after 20 sheets of images were output.

Rank C: streak or the like originating in the unattended setting slightly occurred, and the image defect did not completely disappear after 20 sheets of images were output, but completely disappeared after the laser printer was left for 24 hours.

Rank D: streak or the like originating in the unattended setting clearly occurred. The image defect does not completely disappear even after the laser printer was left for 24 hours.

Figure 8:
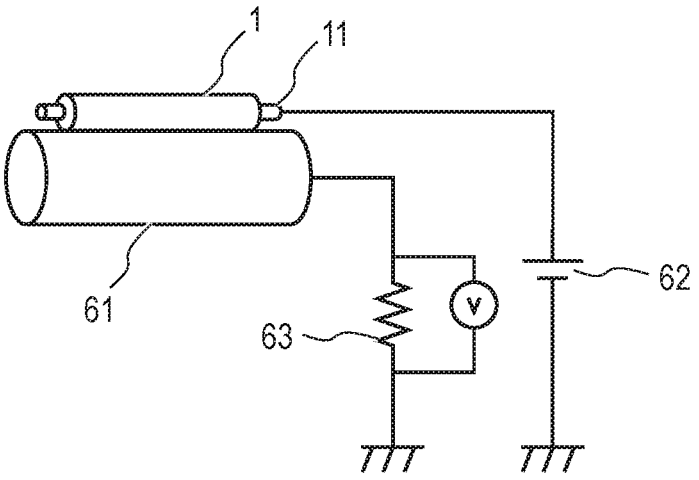
FIG. 8 is a schematic view of an apparatus for measuring an electric resistance of an electro-conductive member according to the present disclosure.

[4-2] Measurement of unevenness of electric resistance in abutting portion on photosensitive drum and non-abutting portion The electro-conductive member used for the image evaluation in the above [4-1] was taken out from the process cartridge, and the electric resistances in the abutting portion on the photosensitive drum and in the non-abutting portion were measured. The measurement was performed immediately after 20 sheets of halftone images were output. FIG. 8 illustrates a schematic diagram of an apparatus for measuring an electric resistance of an electro-conductive member. Both ends 11 of a shaft body 1 of the electro-conductive member are pressed to a columnar aluminum drum 61 having a diameter of 30 mm by an unillustrated pressing unit, and the electro-conductive member rotates while being driven by a rotational drive of the aluminum drum. In this state, a DC voltage was applied to the core metal portion of the electro-conductive member with the use of a power source 62, a voltage applied to a reference resistor 63 was measured which was connected to the aluminum drum in series, and thereby a current value was measured which flowed through the electro-conductive member. The measurement was performed under an environment of a temperature of 23° C. and a relative humidity of 50%, while a reference resistance of 1 kΩ was used, a number of rotations of the aluminum drum was set at 30 rpm, and a DC voltage of 200 V was applied.

A multimeter was connected to the reference resistor, and the measurement was performed at a sampling frequency of 100 Hz.

Figure 9:
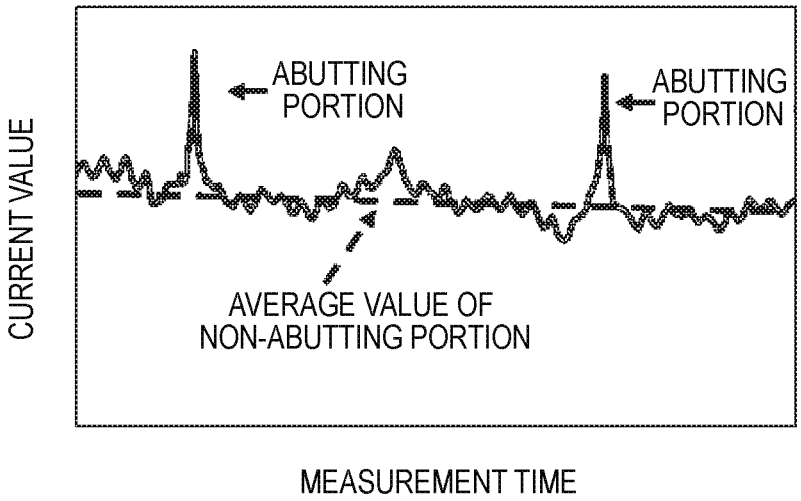
FIG. 9 illustrates a diagram which illustrates an example of electric resistance measurement of an electro-conductive member according to the present disclosure.

FIG. 9 illustrates an example of the measurement result. As is illustrated in FIG. 9, local maximum values of the measured current value are observed at the abutting portion of the electro-conductive member on the photosensitive drum, which indicates that the resistance decreases there. The current values of the non-abutting portions were determined to be a reference value, and a value obtained by dividing the local maximum value by the reference value was defined as the unevenness of the electric resistance. For example, when the local maximum value is 12000 μA and the reference value is 6000 μA, the unevenness of the electric resistance is 2.0. Table 6 and Table 8 show the evaluation results in the Examples and Comparative Examples, respectively.

Examples 2 to 39

Similarly to the electro-conductive member (1) of Example 1, the above characteristics of the electro-conductive layer were evaluated for the electro-conductive members (2) to (39). In addition, images were formed while the electro-conductive members (2) to (39) were each used as charging members, and the images were evaluated. Tables 5 and 6 show the results of the evaluation for various characteristics and the image evaluation, in Examples 2 to 39.

TABLE 5-1

| Example | Member's number | Rubber composition for domain | Matrix composition | Styrene content (% by mass) | Nitrile content (% by mass) | Difference between SP values $(J/cm^3)^{0.5}$ | Confirmation of matrix-domain structure | Domain volume fraction (vol %) | Dynamic viscoelasticity 80 Hz Tanδ 2 | Tanδ 1 | Tanδ 1/Tanδ 2 (A) | Dynamic viscoelasticity 0.1 Hz Tanδ 2 | Tanδ 1 | Tanδ 1/Tanδ 2 (B) |
|---|---|---|---|---|---|---|---|---|---|---|---|---|---|---|
| 1 | 1 | NBR | IR | — | 14.2 | 0.2 | ○ | 28.7 | 0.18 | 0.11 | 0.57 | 0.39 | 0.09 | 0.23 |
| 2 | 2 | | | — | 40.8 | 3.9 | ○ | 29.1 | 0.25 | 0.11 | 0.46 | 0.51 | 0.09 | 0.17 |
| 3 | 3 | | | — | 26.1 | 1.9 | ○ | 28.9 | 0.24 | 0.12 | 0.50 | 0.42 | 0.09 | 0.21 |
| 4 | 4 | IR | NBR | — | 15.0 | 0.3 | ○ | 20.6 | 0.26 | 0.27 | 1.04 | 0.45 | 0.38 | 0.84 |
| 5 | 5 | | | — | 33.8 | 2.9 | ○ | 20.2 | 0.26 | 0.19 | 0.73 | 0.45 | 0.26 | 0.58 |
| 6 | 6 | SBR | IR | 43.4 | — | 0.5 | ○ | 30.0 | 0.25 | 0.12 | 0.48 | 0.44 | 0.12 | 0.27 |
| 7 | 7 | IR | SBR | 39.2 | — | 0.4 | ○ | 29.7 | 0.27 | 0.12 | 0.45 | 0.45 | 0.14 | 0.31 |
| 8 | 8 | CR | IR | — | — | 0.7 | ○ | 26.8 | 0.27 | 0.12 | 0.45 | 0.57 | 0.09 | 0.16 |
| 9 | 9 | IR | CR | — | — | 0.6 | ○ | 28.3 | 0.26 | 0.20 | 0.76 | 0.45 | 0.12 | 0.27 |
| 10 | 10 | BR | SBR | 42.8 | — | 0.6 | ○ | 29.6 | 0.25 | 0.12 | 0.48 | 0.51 | 0.14 | 0.27 |
| 11 | 11 | SBR | BR | 43.1 | — | 0.6 | ○ | 29.8 | 0.24 | 0.11 | 0.46 | 0.45 | 0.08 | 0.18 |
| 12 | 12 | NBR | SBR | 24.2 | 15.0 | 0.2 | ○ | 29.1 | 0.18 | 0.13 | 0.70 | 0.32 | 0.20 | 0.63 |
| 13 | 13 | | | 24.1 | 17.6 | 0.6 | ○ | 29.3 | 0.20 | 0.13 | 0.64 | 0.35 | 0.19 | 0.54 |
| 14 | 14 | | | 23.8 | 26.8 | 1.9 | ○ | 29.2 | 0.24 | 0.13 | 0.53 | 0.36 | 0.17 | 0.47 |
| 15 | 15 | | | 16.4 | 32.9 | 2.9 | ○ | 24.2 | 0.26 | 0.12 | 0.47 | 0.33 | 0.15 | 0.45 |
| 16 | 16 | | | 14.8 | 40.6 | 4.0 | ○ | 23.8 | 0.25 | 0.11 | 0.45 | 0.41 | 0.18 | 0.44 |
| 17 | 17 | | | 39.6 | 39.6 | 3.3 | ○ | 23.7 | 0.22 | 0.15 | 0.68 | 0.36 | 0.19 | 0.53 |
| 18 | 18 | | | 43.8 | 33.6 | 2.4 | ○ | 23.9 | 0.26 | 0.17 | 0.66 | 0.32 | 0.25 | 0.78 |
| 19 | 19 | SBR | NBR | 24.2 | 14.9 | 0.2 | ○ | 25.9 | 0.23 | 0.16 | 0.69 | 0.20 | 0.21 | 1.05 |
| 20 | 20 | | | 17.4 | 17.6 | 0.7 | ○ | 25.2 | 0.20 | 0.17 | 0.84 | 0.17 | 0.23 | 1.35 |
| 21 | 21 | | | 24.2 | 17.3 | 0.5 | ○ | 25.4 | 0.23 | 0.17 | 0.72 | 0.29 | 0.21 | 0.72 |
| 22 | 22 | | | 23.9 | 34.1 | 2.9 | ○ | 20.6 | 0.21 | 0.21 | 1.00 | 0.24 | 0.33 | 1.38 |
| 23 | 23 | | | 38.6 | 39.5 | 3.3 | ○ | 20.7 | 0.28 | 0.25 | 0.89 | 0.34 | 0.39 | 1.15 |
| 24 | 24 | | | 14.9 | 40.4 | 4.0 | ○ | 20.8 | 0.19 | 0.27 | 1.42 | 0.26 | 0.42 | 1.62 |
| 25 | 25 | | | 43.2 | 34.6 | 2.5 | ○ | 25.3 | 0.30 | 0.21 | 0.68 | 0.36 | 0.34 | 0.94 |
| 26 | 26 | NBR | SBR | 23.9 | 17.5 | 0.6 | ○ | 30.6 | 0.19 | 0.13 | 0.67 | 0.21 | 0.11 | 0.52 |
| 27 | 27 | | | 24.2 | 17.3 | 0.5 | ○ | 30.4 | 0.17 | 0.12 | 0.71 | 0.20 | 0.10 | 0.50 |
| 28 | 28 | | | 24.0 | 17.4 | 0.6 | ○ | 30.7 | 0.18 | 0.12 | 0.65 | 0.25 | 0.10 | 0.40 |
| 29 | 29 | | | 24.0 | 17.2 | 0.6 | ○ | 30.5 | 0.20 | 0.11 | 0.55 | 0.33 | 0.10 | 0.30 |
| 30 | 30 | SBR | NBR | 23.7 | 33.9 | 2.9 | ○ | 19.4 | 0.21 | 0.20 | 0.96 | 0.15 | 0.28 | 1.87 |
| 31 | 31 | | | 23.5 | 34.1 | 2.9 | ○ | 19.2 | 0.19 | 0.18 | 0.99 | 0.13 | 0.23 | 1.77 |
| 32 | 32 | | | 23.6 | 33.6 | 2.8 | ○ | 19.3 | 0.21 | 0.20 | 0.96 | 0.15 | 0.25 | 1.67 |
| 33 | 33 | | | 23.7 | 33.8 | 2.9 | ○ | 19.2 | 0.19 | 0.18 | 0.97 | 0.13 | 0.23 | 1.77 |
| 34 | 34 | | | 23.8 | 33.4 | 2.8 | ○ | 11.5 | 0.23 | 0.20 | 0.87 | 0.13 | 0.27 | 2.08 |
| 35 | 35 | | | 23.8 | 33.8 | 2.8 | ○ | 14.4 | 0.19 | 0.19 | 1.02 | 0.13 | 0.23 | 1.77 |
| 36 | 36 | | | 23.9 | 33.6 | 2.8 | ○ | 38.2 | 0.18 | 0.18 | 0.98 | 0.13 | 0.23 | 1.77 |
| 37 | 37 | | | 24.2 | 34.3 | 2.9 | ○ | 40.5 | 0.19 | 0.20 | 1.04 | 0.13 | 0.23 | 1.77 |
| 38 | 38 | | | 15.4 | 39.2 | 4.0 | ○ | 21.6 | 0.19 | 0.38 | 2.00 | 0.26 | 0.72 | 2.77 |
| 39 | 39 | | | 24.2 | 34.2 | 2.9 | ○ | 20.5 | 0.21 | 0.21 | 1.00 | 0.34 | 0.39 | 1.15 |

TABLE 6

| Example number | Member's number | Vulcanization accelerator identification result | Domain volume resistance (Ω · cm) | Domain size (μm) | Distance between domains (μm) | Domain uniformity | Matrix volume resistance (Ω · cm) | MD-1 | Rank of unattended set | Unevenness of electric resistance |
|---|---|---|---|---|---|---|---|---|---|---|
| 1 | 1 | DM/TT | 2.80E−03 | 0.8 | 0.3 | 0.29 | 8.90E−15 | 49 | C | 2.1 |
| 2 | 2 | | 1.00E−01 | 3.7 | 2.4 | 0.57 | 1.00E−15 | 58 | C | 2.3 |
| 3 | 3 | | 3.90E−02 | 2.3 | 1.8 | 0.41 | 9.40E−15 | 50 | B | 2.0 |
| 4 | 4 | | 5.40E−03 | 0.9 | 0.3 | 0.31 | 8.10E−10 | 54 | C | 2.4 |
| 5 | 5 | | 5.60E−03 | 2.1 | 1.9 | 0.42 | 2.10E−09 | 57 | C | 2.3 |
| 6 | 6 | | 8.60E−01 | 1.8 | 1.5 | 0.32 | 1.10E−16 | 59 | C | 2.2 |
| 7 | 7 | | 1.80E−02 | 0.6 | 0.3 | 0.14 | 5.40E−12 | 62 | B | 2.0 |
| 8 | 8 | ETU/TRA | 1.10E−02 | 1.6 | 0.7 | 0.34 | 6.40E−15 | 63 | C | 2.7 |
| 9 | 9 | | 5.40E−03 | 1.4 | 0.7 | 0.29 | 3.40E−10 | 71 | C | 2.6 |
| 10 | 10 | DM/TT | 8.60E−02 | 0.9 | 0.3 | 0.31 | 2.00E−12 | 58 | C | 2.5 |
| 11 | 11 | | 1.90E−03 | 0.7 | 0.3 | 0.27 | 2.40E−15 | 53 | C | 2.4 |
| 12 | 12 | DM/TBZTD | 1.10E−04 | 0.3 | 0.2 | 0.12 | 1.20E−13 | 60 | B | 2.1 |
| 13 | 13 | | 8.90E−03 | 0.5 | 0.3 | 0.15 | 1.10E−13 | 61 | B | 2.0 |
| 14 | 14 | | 7.40E−03 | 1.2 | 0.6 | 0.24 | 9.60E−12 | 63 | A | 1.8 |
| 15 | 15 | | 5.10E−03 | 2.4 | 1.9 | 0.45 | 1.10E−14 | 63 | B | 2.1 |
| 16 | 16 | | 2.80E−03 | 3.9 | 2.6 | 0.57 | 2.40E−14 | 64 | C | 2.4 |
| 17 | 17 | | 3.40E−03 | 2.8 | 1.8 | 0.35 | 6.40E−12 | 68 | B | 2.1 |
| 18 | 18 | | 6.10E−03 | 2.0 | 1.5 | 0.34 | 2.10E−12 | 70 | A | 1.8 |
| 19 | 19 | | 1.10E−03 | 0.2 | 0.1 | 0.09 | 9.80E−10 | 59 | B | 2.1 |
| 20 | 20 | | 2.50E−03 | 0.8 | 0.3 | 0.08 | 1.40E−10 | 57 | B | 2.0 |
| 21 | 21 | | 1.00E−03 | 0.5 | 0.3 | 0.07 | 1.30E−10 | 60 | B | 2.1 |

TABLE 6-continued

| Example number | Member's number | Vulcanization accelerator identification result | Domain volume resistance (Ω · cm) | Domain size (μm) | Distance between domains (μm) | Domain uniformity | Matrix volume resistance (Ω · cm) | MD-1 | Rank of unattended set | Unevenness of electric resistance |
|---|---|---|---|---|---|---|---|---|---|---|
| 22 | 22 | | 9.80E−02 | 2.1 | 1.2 | 0.27 | 9.60E−08 | 62 | A | 1.7 |
| 23 | 23 | | 6.70E−02 | 2.4 | 1.3 | 0.34 | 2.40E−08 | 68 | B | 2.1 |
| 24 | 24 | | 1.80E−03 | 2.9 | 1.5 | 0.40 | 1.00E−08 | 64 | C | 2.3 |
| 25 | 25 | | 5.40E−02 | 1.8 | 1.1 | 0.28 | 1.20E−09 | 71 | B | 2.1 |
| 26 | 26 | NS/TBZTD | 3.80E−03 | 0.4 | 0.3 | 0.12 | 2.30E−13 | 63 | A | 1.5 |
| 27 | 27 | CZ/TBZTD | 4.60E−03 | 0.4 | 0.3 | 0.13 | 2.80E−13 | 64 | A | 1.4 |
| 28 | 28 | M/TBZTD | 2.40E−03 | 0.4 | 0.3 | 0.18 | 1.30E−13 | 62 | B | 2.0 |
| 29 | 29 | DP/TBZTD | 1.90E−03 | 0.5 | 0.4 | 0.20 | 8.60E−12 | 60 | B | 2.2 |
| 30 | 30 | NS/TBZTD | 7.50E−02 | 2.0 | 1.4 | 0.34 | 1.30E−09 | 62 | A | 1.6 |
| 31 | 31 | CZ/TBZTD | 6.80E−02 | 1.9 | 1.1 | 0.33 | 1.50E−09 | 63 | A | 1.6 |
| 32 | 32 | M/TBZTD | 8.40E−02 | 2.1 | 1.6 | 0.35 | 9.90E−08 | 61 | B | 2.0 |
| 33 | 33 | DP/TBZTD | 5.50E−02 | 2.2 | 1.6 | 0.36 | 7.80E−08 | 59 | C | 2.3 |
| 34 | 34 | CZ/TBZTD | 6.90E−02 | 2.2 | 1.2 | 0.34 | 1.70E−09 | 58 | B | 1.9 |
| 35 | 35 | | 7.20E−02 | 2.3 | 1.1 | 0.35 | 1.80E−09 | 59 | A | 1.5 |
| 36 | 36 | | 6.00E−02 | 1.8 | 0.9 | 0.32 | 1.40E−09 | 66 | A | 1.7 |
| 37 | 37 | | 5.40E−00 | 1.5 | 0.9 | 0.33 | 1.60E−09 | 67 | B | 2.1 |
| 38 | 38 | DM/TBZTD | 2.10E−02 | 2.6 | 1.6 | 0.33 | 4.30E−11 | 85 | C | 2.5 |
| 39 | 39 | | 1.00E−03 | 2.1 | 1.2 | 0.27 | 1.10E−09 | 62 | B | 1.8 |

Example 40

An electro-conductive member B1 was manufactured in the same manner as that in Example 39, except that the diameter of the electro-conductive support was changed to 5 mm, and the outer diameter of the electro-conductive member after having been polished was set at 10.0 mm.

Next, the electro-conductive member B1 was used as a transfer member, and was subjected to the following evaluation. Regarding the characteristic evaluation, the same evaluation as in Example 1 was performed. Regarding the image evaluation, the following evaluation was performed. First, in order to condition the electro-conductive member B1 to the measurement environment, the electro-conductive member B1 was left in an environment at a temperature of 23° C. and a relative humidity of 50% for 48 hours. Next, as an electrophotographic image forming apparatus, an electrophotographic type of laser printer (trade name: Laserjet M608dn, manufactured by HP Inc.) was prepared. Then, an electro-conductive member B1 was incorporated as a transfer member. As for the photosensitive drum incorporated in the process cartridge, the same photosensitive drum was used as that which was used in the evaluation of the electro-conductive members (1) to (39). In addition, as for the charging member, the same charging member was used as that which was used in the evaluation of the electro-conductive member (22). In addition, the laser printer was altered so that an abutting pressure between the photosensitive drum and the electro-conductive member B1 became 1250 gf (12.26 N), by adjusting a length of a spring of a bearing component which supported the electro-conductive member.

In order to evaluate the image in a high-speed process, the laser printer was altered so that the number of output sheets per unit time became 75 sheets/minute on A4 size paper, which was more than the original number of output sheets. At this time, an output speed of the recording medium was set at 370 mm/sec, and the image resolution was set at 1,200 dpi. In addition, the laser printer was left in an environment of 23° C. and 50% RH for 48 hours. After that, in the same environment, 20000 sheets of images were continuously output.

The output electrophotographic image was such that characters of the letter "E" of the alphabet having a size of 4 points were formed on A4 size paper to reach a printing rate of 1.0%. After that, the laser printer was left for 12 hours in the state of having been stopped and in the same environment, then the charging member was replaced with a new electro-conductive member 18, and 20 sheets of halftone images were output. Thus, the unattended set image was evaluated.

After that, the unattended set streak image was evaluated under the same conditions as in the above [4-1]. After that, under the same conditions as in [4-2], the unevenness of the electric resistance of the abutting portion of the electro-conductive member B1 on the photosensitive drum and the non-abutting portion was measured. Table 7 shows the results of the characteristic evaluation and image evaluation of the electro-conductive member B1.

TABLE 7

| Evaluation of electro-conductive member B1 | | | |
|---|---|---|---|
| Physical properties | Crown amount (μm) | | 0 |
| | Rubber composition for domain | | SBR |
| | Matrix composition | | NBR |
| | Confirmation of matrix-domain structure | | ○ |
| | Domain volume fraction (vol %) | | 20.6 |
| | Sulfur vulcanization Presence or absence | | Presence |
| | Styrene content (% by mass) | | 23.8 |
| | Nitrile content (% by mass) | | 34.2 |
| | Difference between SP values ($(J/cm^3)^{0.5}$) | | 2.9 |
| | Dynamic viscoelasticity 80 Hz | tanδ2 | 0.208 |
| | | tanδ1 | 0.208 |
| | | tanδ1/tanδ2 | 1 |
| | Dynamic viscoelasticity 0.1 Hz | tanδ2 | 0.24 |
| | | tanδ1 | 0.33 |
| | | tanδ1/tanδ2 | 1.38 |
| | Vulcanization accelerator identification result | | DM/TBZTD |
| | Domain volume resistance | Ω · cm | 9.80E+02 |
| | Domain size | μm | 2.1 |
| | Distance between domains | μm | 1.2 |
| | Domain uniformity | | 0.27 |
| | Matrix volume resistance | Ω · cm | 9.50E+08 |
| | MD-1 hardness (°) | | 62 |
| Image evaluation | Rank of unattended set | | A |
| | Unevenness of resistance | | 1.9 |

Comparative Example 1

An electro-conductive member C1 was manufactured and evaluated in the same manner as that in Example 1, except that EPDM (1) was used as the raw rubber material for the domain, and hydrin was used as the raw rubber material for the matrix. Table 8 shows the evaluation results.

In the present Comparative Example, it was confirmed that a matrix-domain structure was formed, but both of the domain and the matrix are constituted by a non-diene rubber. Because of this, a chemical bond between the matrix and the domain could not be sufficiently obtained, and it is assumed that a difference in the discharge characteristics occurred between the abutting portion on the photosensitive drum and the non-abutting portion, due to the change of the structure such as the agglomeration of the domains with each other. In addition, the tan δ1/tan δ2 in the high frequency region (80 Hz) was low. Because of this, the electro-conductive layer was not able to sufficiently recover from deformation at the time of continuous printing.

As a result, the unevenness of the resistance, which was measured after the evaluation of the unattended set image, became as very large as 3.6, and the unattended set image became rank D.

Comparative Example 2

An electro-conductive member C2 was manufactured and evaluated in the same manner as that in Example 1, except that the raw rubber material for the domain was changed to isoprene (1), and the raw rubber material for the matrix was changed to SBR (3). Table 8 shows the evaluation results.

In the present Comparative Example, the difference between the SP values of the rubbers which constitute the domain and the matrix was 0, and it could not be confirmed whether the matrix-domain structure was formed. As a result, the electro-conductive member C2 could not form a three-dimensional network via cross-links at the interface between the domain and the matrix, and became a structure which could not exhibit an excellent effect of suppressing the mechanical distortion against the external force. In addition, the electro-conductive particle was mixed in the matrix, and thereby the matrix could not exhibit the excellent rubber elasticity.

As a result, the unevenness of the resistance which was measured after the evaluation of the unattended set image became 3.3, and the unattended set image became rank D. For information, as for the present Comparative Example, the blended ratio of the electro-conductive particle and the filler which were originally contained in the domain and the matrix could not be analyzed, because the rubbers of the domain and the matrix resulted in dissolving into each other. Because of this, the rubber sheet constituting the domain and the matrix could not be reproduced, and the dynamic viscoelasticity could not be measured. The volume fractions of the domain in Table 8 describe volume ratios of isoprene which was identified by the chemical structure analysis.

Comparative Example 3

An electro-conductive member C3 was manufactured and evaluated in the same manner as that in Example 1, except that the raw rubber material for the domain was changed to EPDM (2), and the raw rubber material for the matrix was changed to NBR (5). Table 8 shows the evaluation results.

In the present Comparative Example, it was confirmed that the matrix-domain structure was formed, but the rubber constituting the domain was EPDM of the non-diene rubber. The monomer derived from a diene skeleton which is contained in the EPDM is extremely small, and accordingly the chemical bond between the matrix and the domain cannot be sufficiently obtained. In addition, because the chemical structures of the domain and the matrix are greatly different in monomer units, the value of tan δ1/tan δ2 in a high frequency region (80 Hz) is low. Because of this, the electro-conductive layer was not able to sufficiently recover from deformation at the time of continuous printing.

In addition, a difference between the SP values of the rubber in the domain and the matrix was as very large as 4.2, and the dispersion of the domains became ununiform, and the electro-conductive member C3 became a configuration which could not exhibit a sufficient responsiveness to the deformation.

As a result, the unevenness of the resistance, which was measured after the evaluation of the unattended set image, became as very large as 3.5, and the unattended set image became rank D. This is assumed to be because a significant difference was caused in discharge characteristics between the abutting portion on the photosensitive drum and the non-abutting portion, due to a change of the structure such as agglomeration of domains with each other, which were ununiformly dispersed and had a large size.

Comparative Example 4

An electro-conductive member C4 was manufactured and evaluated in the same manner as that in Example 11, except that the vulcanization accelerator (1) was changed to the vulcanization accelerator (9) (PZ). Table 8 shows the evaluation results.

In the present Comparative Example, it was confirmed that the matrix-domain structure was formed. Furthermore, it was also confirmed that the rubbers constituting the domain and the matrix were SBR and BR of the diene-based rubber, respectively. However, the value of tan δ1/tan δ2 in the high frequency region (80 Hz) was extremely low. Because of this, the electro-conductive layer was not able to sufficiently recover from deformation at the time of continuous printing, This is assumed to be because the affinity between the vulcanization accelerator and the rubbers constituting the domain and the matrix is insufficient, and cross-linking reactions in the inside of the domain, the inside of the matrix and at the matrix-domain interface became ununiform.

As a result, the unevenness of the resistance which was measured after the evaluation of the unattended set image became 3.1, and the unattended set image became rank D.

Comparative Example 5

An electro-conductive member C5 was manufactured and evaluated in the same manner as that in Example 38, except that the vulcanization accelerator (1) was changed to the vulcanization accelerator (9) (PZ). Table 8 shows the evaluation results.

In the present Comparative Example, it was confirmed that the matrix-domain structure was formed. Furthermore, it was also confirmed that the rubbers constituting the domain and the matrix was SBR and NBR of the diene-based rubber, respectively. However, the value of tan δ1/tan δ2 in the high frequency region (80 Hz) was extremely high, and the matrix-domain structure became a configuration in which there was a remarkably large bias in the relaxation behaviors of the mechanical distortion, which occurred at the time of continuous printing.

Specifically, the matrix-domain structure has a configuration in which the distortion accumulated in the matrix becomes insufficiently relaxed. Because of this, it is assumed that the matrix could not exhibit the excellent rubber elasticity, the responsiveness to the deformation was remarkably lowered which was caused by the external force, and a change of the matrix-domain structure occurred. This is considered to be because the affinity between the vulcanization accelerator and the rubbers constituting the domain and the matrix was insufficient, in the same manner as that in Comparative Example 4.

As a result, the unevenness of the resistance which was measured after the evaluation of the unattended set image became 3.2, and the unattended set image became rank D.

Comparative Example 6

An electro-conductive member C6 was manufactured and evaluated in the same manner as that in Example 1, except that the raw rubber material for the domain was changed to NBR (3), and the raw rubber material for the matrix was changed to NBR (4). Table 8 shows the evaluation results.

In the present Comparative Example, it could not be confirmed that the matrix-domain structure was formed. In addition, as a result of the analysis of the chemical structure, only NBR was detected as the rubber. Accordingly, the electro-conductive member C6 could not form a three-dimensional network via cross-links at the interface between the domain and the matrix, and became a configuration which could not exhibit an excellent effect of suppressing the mechanical distortion against the external force. In addition, the electro-conductive particle was mixed in the matrix, and thereby the matrix could not exhibit the excellent rubber elasticity.

As a result, the unevenness of the resistance which was measured after the evaluation of the unattended set image became 3.4, and the unattended set image became rank D. For information, as for the present Comparative Example, the blended ratio of the electro-conductive particle and the filler which were originally contained in the domain and the matrix could not be analyzed, because the rubbers of the domain and the matrix completely dissolved into each other. Because of this, the rubber sheets constituting the domain and the matrix could not be reproduced, and the dynamic viscoelasticities could not be measured. In addition, the SP value could not be analyzed. Accordingly, as for the difference between the SP values in Table 8, the difference between the SP values of the two types of NBR is described as reference data, which were used in the present Comparative Example.

TABLE 8

| | Comparative Example | | 1 | 2 | 3 | 4 | 5 | 6 |
|---|---|---|---|---|---|---|---|---|
| | Number of electro-conductive member | | C1 | C2 | C3 | C4 | C5 | C6 |
| Physical properties | Rubber composition for domain | Type of rubber | EPDM1 | Mixture of IR and | EPDM2 | SBR | SBR | NBR alone |
| | Matrix composition | Type of rubber | Hydrin | SBR | NBR | BR | NBR | |
| | Confirmation of matrix-domain structure | | ○ | × | ○ | ○ | ○ | × |
| | Domain volume fraction | vol % | 26.4 | 25.9 | 28.1 | 29.9 | 21.8 | Out of measure |
| | | | | (Ratio of IR) | | | | |
| | Difference between SP values | $(J/cm^3)^{0.5}$ | 2.1 | 0 | 4.2 | 0.6 | 4.0 | 1.4* (Reference) |
| | Dynamic viscoelasticity | tanδ2 | 0.35 | Out of measure | 0.36 | 0.29 | 0.19 | Out of measure |
| | 80 Hz | tanδ1 | 0.05 | Out of measure | 0.10 | 0.12 | 0.40 | Out of measure |
| | | tanδ1/tanδ2 (A) | 0.14 | Out of measure | 0.28 | 0.41 | 2.11 | Out of measure |
| | Dynamic viscoelasticity | tanδ2 | 0.58 | Out of measure | 0.55 | 0.58 | 0.23 | Out of measure |
| | 0.1 Hz | tanδ1 | 0.04 | Out of measure | 0.19 | 0.08 | 0.70 | Out of measure |
| | | tanδ1/tanδ2 (B) | 0.07 | Out of measure | 0.35 | 0.14 | 3.04 | Out of measure |
| | Frequency dependency of viscoelasticity | (A)/(B) | 2.07 | Out of measure | 0.80 | 3.00 | 0.69 | Out of measure |
| | Vulcanization accelerator identification result | | | DM/TT | | PZ/TT | | DM/TT |
| | Volume resistivity | Matrix | 9.70E−06 | — | 8.10E−10 | 1.90E−15 | 2.90E−11 | — |
| | (Ω · cm) | Domain | 2.50E−03 | — | 4.40E−03 | 1.70E−03 | 1.70E−02 | — |
| | Domain size | μm | 3.2 | — | 4.5 | 0.7 | 2.5 | — |
| | Distance between domains | μm | 2.0 | — | 3.1 | 0.3 | 1.7 | — |
| | Domain uniformity | | 0.51 | — | 0.71 | 0.29 | 0.34 | — |
| | MD-1 hardness (°) | | 60 | 58 | 61 | 51 | 82 | 59 |
| Image evaluation | Rank of unattended set | | D | D | D | D | D | D |
| | Unevenness of resistance | | 3.6 | 3.3 | 3.5 | 3.1 | 3.2 | 3.4 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-069098, filed Mar. 29, 2019 which is hereby incorporated by reference herein in its entirety.

What is claimed is:

1. An electro-conductive member for electrophotography, comprising:

an electro-conductive support and an electro-conductive layer in this order;

the electro-conductive layer comprising a matrix and domains, the matrix having a volume resistivity of $1.0\times10^{8}$ Ω·cm or higher, and comprising a first rubber composition that contains a cross-linked product of a first rubber; and the domains being electro-conductive and dispersed in the matrix, each of the domains having a volume resistivity of $1.0\times10^{1}$ to $1.0\times10^{4}$ Ω·cm, and comprising a second rubber composition that contains a cross-linked product of a second rubber and an electro-conductive particle, wherein the first rubber is acrylonitrile-butadiene rubber and the second rubber is styrene-butadiene rubber, or the first rubber is styrene-butadiene rubber and the second rubber is acrylonitrile-butadiene rubber, a difference of absolute values of solubility parameters (SP values) between the first and second rubbers is 0.2 to 4.0 $(J/cm^3)^{0.5}$, tan δ1/tan δ2 is 0.45 to 2.00, where tan δ1 and tan δ2 are respectively loss factors of the first and second rubber compositions measured at 23° C., a relative humidity of 50% and a frequency of 80 Hz, and the amount of the electro-conductive particles in the domains is 50 to 150 parts by mass per 100 parts by mass of the second rubber.

2. The electro-conductive member according to claim 1, wherein a content ratio of a monomer unit derived from styrene in the styrene-butadiene rubber is 18 to 40% by mass.

3. The electro-conductive member according to claim 1, wherein a content ratio of a monomer unit derived from acrylonitrile in the acrylonitrile-butadiene rubber is 18 to 40% by mass.

4. The electro-conductive member according to claim 1, wherein a volume fraction of the domain in the electro-conductive layer is 10 to 40% by volume.

5. The electro-conductive member according to claim 1, wherein the electro-conductive particle is carbon black.

6. The electro-conductive member according to claim 1, wherein the electro-conductive layer comprises a cross-linked body of a rubber mixture for forming the electro-conductive layer, the rubber mixture comprising the first and second rubbers, the electro-conductive particle, sulfur and a vulcanization accelerator, and the vulcanization accelerator comprises a thiazole-based compound.

7. The electro-conductive member according to claim 6, wherein the thiazole-based compound is a sulfenamide-based compound.

8. A process cartridge that is detachably attachable to a main body of an electrophotographic image forming apparatus, comprising:

an electrophotographic photosensitive member;

an electro-conductive member for electrophotography, the electro-conductive member comprising an electro-conductive support and an electro-conductive layer in this order;

the electro-conductive layer comprising a matrix and domains, the matrix having a volume resistivity of $1.0\times10^{8}$ Ω·cm or higher, and comprising a first rubber composition that contains a cross-linked product of a first rubber; and the domains being electro-conductive; and dispersed in the matrix, each of the domains having a volume resistivity of $1.0\times10^{1}$ to $1.0\times10^{4}$ Ω·cm, and comprising a second rubber composition that contains a cross-linked product of a second rubber and an electro-conductive particle, wherein the first rubber is acrylonitrile-butadiene rubber and the second rubber is styrene-butadiene rubber, or the first rubber is styrene-butadiene rubber and the second rubber is acrylonitrile-butadiene rubber, a difference of absolute values of solubility parameters (SP values) between the first and second rubbers is 0.2 to 4.0 $(J/cm^3)^{0.5}$, tan δ1/tan δ2 is 0.45 to 2.00, where tan δ1 and tan δ2 are respectively loss factors of the first and second rubber compositions measured at 23° C., a relative humidity of 50% and a frequency of 80 Hz, and the amount of the electro-conductive particles in the domains is 50 to 150 parts by mass per 100 parts by mass of the second rubber.

9. The process cartridge according to claim 8, wherein the electro-conductive member is a charging member that is configured to charge the electrophotographic photosensitive member.

10. An electrophotographic image forming apparatus, comprising:

an electro-conductive member, the electro-conductive member comprising an electro-conductive support and an electro-conductive layer in this order;

the electro-conductive layer comprising a matrix and domains, the matrix having a volume resistivity of $1.0\times10^{8}$ Ω·cm or higher, and comprising a first rubber composition that contains a cross-linked product of a first rubber; and the domains being electro-conductive and dispersed in the matrix, each of the domains having a volume resistivity of $1.0\times10^{1}$ to $1.0\times10^{4}$ Ω·cm, and comprising a second rubber composition that contains a cross-linked product of a second rubber and an electro-conductive particle, wherein the first rubber is acrylonitrile-butadiene rubber and the second rubber is styrene-butadiene rubber, or the first rubber is styrene-butadiene rubber and the second rubber is acrylonitrile-butadiene rubber, a difference of absolute values of solubility parameters (SP values) between the first and second rubbers is 0.2 to 4.0 $(J/cm^3)^{0.5}$, tan δ1/tan δ2 is 0.45 to 2.00, where tan δ1 and tan δ2 are respectively loss factors of the first and second rubber compositions measured at 23° C., a relative humidity of 50% and a frequency of 80 Hz, and the amount of the electro-conductive particles in the domains is 50 to 150 parts by mass per 100 parts by mass of the second rubber.

11. An electro-conductive member for electrophotography, comprising:

an electro-conductive support and an electro-conductive layer in this order;

the electro-conductive layer comprising a matrix and domains, the matrix having a volume resistivity of $1.0\times10^{8}$ Ω·cm or higher, and comprising a first rubber composition that contains a cross-linked product of a first rubber; and the domains being electro-conductive and dispersed in the matrix, each of the domains having a volume resistivity of $1.0\times10^{1}$ to $1.0\times10^{4}$ Ω·cm, and comprising a second rubber composition that contains a cross-linked product of a second rubber and an electro-conductive particle, wherein the first rubber is styrene-butadiene rubber and the second rubber is acrylonitrile-butadiene rubber, a difference of absolute values of solubility parameters (SP values) between the first and second rubbers is 0.2 to 4.0 $(J/cm^3)^{0.5}$, and tan δ1/tan δ2 is 0.45 to 2.00, where tan δ1 and tan δ2 are respectively loss factors of the first and second rubber compositions measured at 23° C., a relative humidity of 50% and a frequency of 80 Hz.

* * * * *